US010688794B2

(12) United States Patent
Miyao et al.

(10) Patent No.: US 10,688,794 B2
(45) Date of Patent: Jun. 23, 2020

(54) LIQUID CARTRIDGE INCLUDING LIGHT BLOCKING PORTION

(71) Applicant: BROTHER KOGYO KABUSHIKI KAISHA, Nagoya-shi, Aichi-ken (JP)

(72) Inventors: Takahiro Miyao, Nagoya (JP); Akihito Ono, Nagoya (JP); Hiroaki Takahashi, Nagoya (JP); Tetsuro Kobayashi, Nagoya (JP); Fumio Nakazawa, Okazaki (JP); Kosuke Nukui, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/939,671

(22) Filed: Mar. 29, 2018

(65) Prior Publication Data

US 2019/0100015 A1 Apr. 4, 2019

(30) Foreign Application Priority Data

Sep. 29, 2017 (JP) ..... 2017-189587

(51) Int. Cl.
*B41J 2/175* (2006.01)

(52) U.S. Cl.
CPC ..... *B41J 2/1752* (2013.01); *B41J 2/1753* (2013.01); *B41J 2/17509* (2013.01);
(Continued)

(58) Field of Classification Search
CPC .. B41J 2/1752; B41J 2/17546; B41J 2/17566; B41J 2/17553; B41J 2/1753;
(Continued)

(56) References Cited

U.S. PATENT DOCUMENTS 8,007,091 B2 8/2011 Nakamura et al.
2006/0164482 A1* 7/2006 Katayama ..... B41J 2/17509 347/86

(Continued)

FOREIGN PATENT DOCUMENTS

EP 2 524 810 A1 11/2012
EP 3 153 320 A1 4/2017

(Continued)

OTHER PUBLICATIONS

Extended European Search Report issued in related European Patent Application No. 18165164.7, dated Sep. 10, 2018.

(Continued)

*Primary Examiner* — Yaovi M Ameh
(74) *Attorney, Agent, or Firm* — Merchant & Gould P.C.

(57) ABSTRACT

A liquid cartridge is configured to be inserted into a cartridge-attachment section including a casing and a light blocking portion. The casing includes a liquid chamber; a liquid passage extending in a first direction; and a top surface facing upward. The light blocking portion is deformable between a non-deformed state and a deformed state. The light blocking portion, at least in the non-deformed state, is configured to block or attenuate light emitted from the cartridge-attachment section and traveling in a widthwise direction crossing the first direction and a gravitational direction in an upright posture. The light blocking portion in the non-deformed state is configured to be deformed to the deformed state by an external force. The light blocking portion returns to the non-deformed state when the external force is removed from the light blocking portion in the deformed state.

16 Claims, 15 Drawing Sheets

(52) U.S. Cl.
CPC ..... *B41J 2/17513* (2013.01); *B41J 2/17523* (2013.01); *B41J 2/17546* (2013.01); *B41J 2/17553* (2013.01); *B41J 2/17566* (2013.01); *B41J 2/17596* (2013.01); *B41J 2002/17573* (2013.01)

(58) Field of Classification Search
CPC ..... B41J 2/17513; B41J 2/17596; B41J 2/17523; B41J 2/17509; B41J 2002/17573
See application file for complete search history.

(56) References Cited

U.S. PATENT DOCUMENTS

| | | | | |
|---|---|---|---|---|
| 2008/0252702 | A1 | 10/2008 | Aoki et al. | |
| 2010/0103231 | A1 | 4/2010 | Iwamura et al. | |
| 2011/0234716 | A1 | 9/2011 | Kubo et al. | |
| 2013/0033552 | A1 | 2/2013 | Chen et al. | |
| 2013/0050358 | A1 | 2/2013 | Kanbe et al. | |
| 2013/0162733 | A1 | 6/2013 | Nakamura et al. | |
| 2014/0168324 | A1 | 6/2014 | Sasaki | |
| 2016/0167392 | A1 | 6/2016 | Xia et al. | |
| 2016/0279959 | A1* | 9/2016 | Okazaki | B41J 2/17543 |
| 2017/0282580 | A1* | 10/2017 | Takahashi | B41J 2/17543 |
| 2018/0003704 | A1* | 1/2018 | Horii | G01N 35/00069 |

FOREIGN PATENT DOCUMENTS

| | | | |
|---|---|---|---|
| EP | 3 225 401 | A1 | 10/2017 |
| EP | 3 225 402 | A1 | 10/2017 |
| EP | 3 228 460 | A1 | 10/2017 |
| EP | 3 260 298 | A1 | 12/2017 |
| JP | 6-143611 | A | 5/1994 |
| JP | 7-304184 | A | 11/1995 |
| JP | 2002-120378 | A | 4/2002 |
| JP | 2007-44936 | A | 2/2007 |
| JP | 2008-221803 | A | 9/2008 |
| JP | 3170344 | U | 8/2011 |
| JP | 2013-49167 | A | 3/2013 |

OTHER PUBLICATIONS

International Search Report and Written Opinion issued in related International Patent Application No. PCT/JP2018/013085, dated May 29, 2018.

Extended European Search Report issued in related European Patent Application No. 18165153.0, dated Sep. 21, 2018.

Extended European Search Report issued in related European Patent Application No. 18165159.7, dated Sep. 4, 2018.

Extended European Search Report issued in related European Patent Application No. 18165149.8, dated Sep. 4, 2018.

Office Action issued in related U.S. Appl. No. 15/939,489, dated Oct. 4, 2018.

Office Action issued in related U.S. Appl. No. 15/939,460, dated Dec. 4, 2018.

Office Action issued in related U.S. Appl. No. 15/939,388, dated Nov. 6, 2018.

* cited by examiner

LIQUID CARTRIDGE INCLUDING LIGHT BLOCKING PORTION

CROSS REFERENCE TO RELATED APPLICATION

This application claims priority from Japanese Patent Application No. 2017-189587 filed Sep. 29, 2017. The entire content of the priority application is incorporated herein by reference.

TECHNICAL FIELD

The present disclosure relates to a liquid cartridge that stores liquid; and a system provided with the liquid cartridge, and a mounting unit in which the liquid cartridge is mountable.

BACKGROUND

As a conventional system well-known in the art, there is known an inkjet-recording apparatus that includes an ink cartridge, and an attachment section to which the ink cartridge is detachably attachable.

SUMMARY

In one inkjet-recording device, a rib or other irradiated portion is provided on the ink cartridge, and an optical sensor is provided in the mounting unit. When the ink cartridge is attached in the mounting unit, the irradiated portion of the ink cartridge is positioned in the optical path of the optical sensor. However, the irradiated portion is not positioned in the optical path of the optical sensor when the ink cartridge is not attached in the mounting unit. Hence, the signal outputted by the optical sensor changes based on whether the ink cartridge is attached in the mounting unit. By detecting changes in the signal, the inkjet-recording device can determine the attached state of the ink cartridge.

However, in the ink cartridge described in the prior art, the irradiated portion protrudes outward from the outer surface of the casing constituting the ink cartridge. Consequently, the irradiated portion is susceptible to impacts from parts outside the ink cartridge and could be broken when incurring such impacts.

In view of the foregoing, it is an object of the present disclosure to provide a liquid cartridge having an irradiated portion and a configuration that reduces the potential for damage to the irradiated portion.

According to one aspect, the disclosure provides a liquid cartridge configured to be inserted into a cartridge-attachment section including a casing and a light blocking portion. The casing includes a liquid chamber storing liquid therein; a liquid passage extending in a first direction crossing a gravitational direction from a liquid chamber in an upright posture of the liquid cartridge; and a top surface facing upward. The light blocking portion protrudes upward relative to the top surface. The light blocking portion is deformable between a non-deformed state and a deformed state. The light blocking portion, at least in the non-deformed state, is configured to block or attenuate light emitted from the cartridge-attachment section and traveling in a widthwise direction crossing the first direction and the gravitational direction in the upright posture. The light blocking portion in the non-deformed state is configured to be deformed to the deformed state by an external force. The light blocking portion returns to the non-deformed state when the external force is removed from the light blocking portion in the deformed state.

BRIEF DESCRIPTION OF THE DRAWINGS

The particular features and advantages of the disclosure will become apparent from the following description taken in connection with the accompanying drawings, in which.

DETAILED DESCRIPTION

Figure 1:
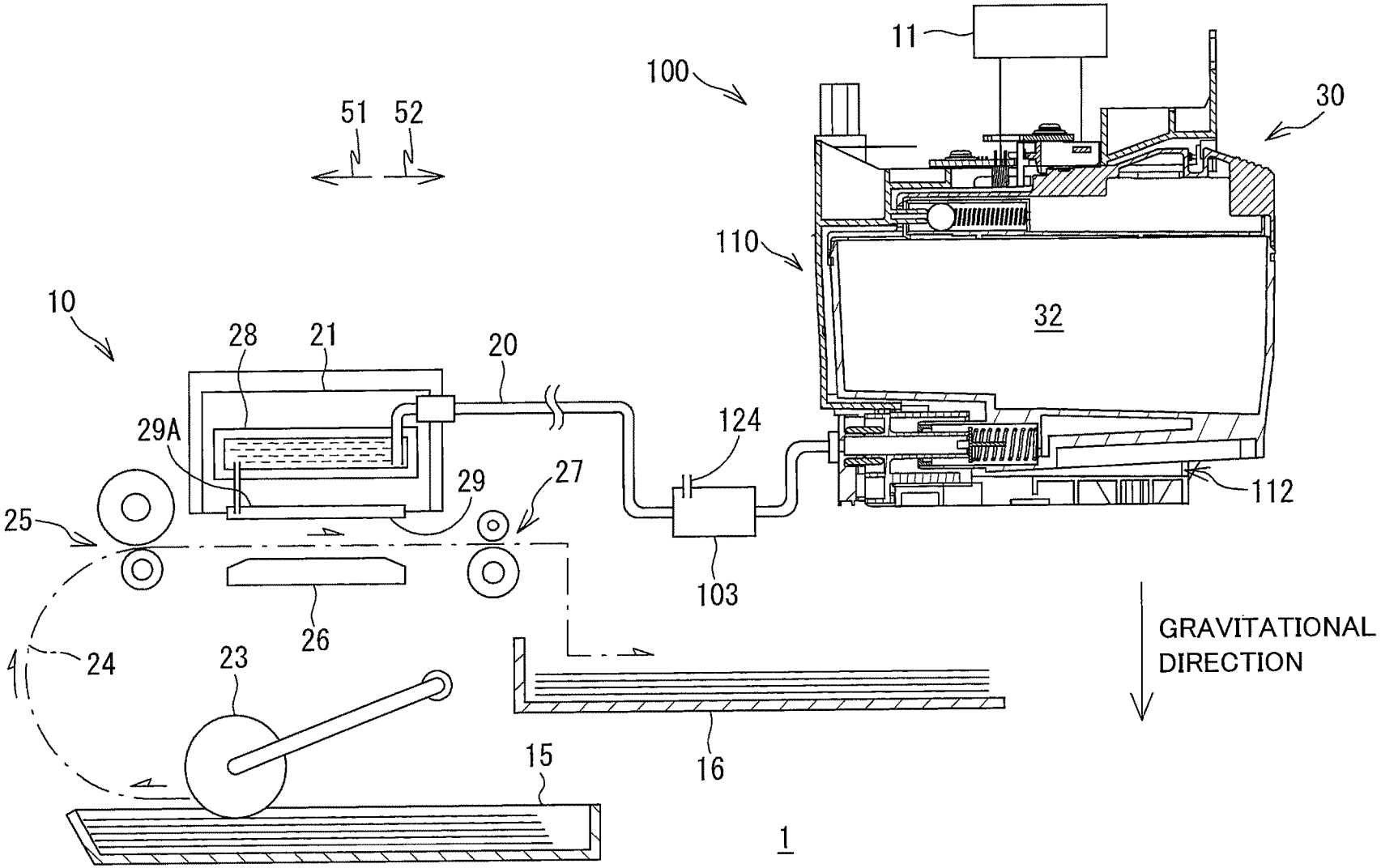
FIG. 1 is a schematic cross-sectional diagram conceptually illustrating a system including an ink cartridge according to an embodiment of the present disclosure and a printer including a cartridge-attachment section configured to detachably accommodate the ink cartridge according to the embodiment, and conceptually illustrating an internal configuration of the printer.

Hereinafter, embodiments of the disclosure will be described in detail while referring to accompanying drawings. It would be apparent to those skilled in the art that the embodiments described below are merely examples of the present disclosure and modifications and variations may be made therein without departing from the scope of the disclosure.

In the following description, a frontward direction 51 is defined as the direction that an ink cartridge 30 according to a first embodiment is inserted into a cartridge-attachment section 110. In the preferred embodiment, the direction of insertion is orthogonal to the gravitational direction. An upright posture of the ink cartridge 30 will be defined as the state in which the ink cartridge 30 is configured to be inserted into the cartridge-attachment section 110 in a direction orthogonal to the gravitational direction. A rearward direction 52 is defined as the direction opposite the frontward direction 51 and is the direction in which the ink cartridge 30 is extracted from the cartridge-attachment section 110. In the preferred embodiment, the frontward direction 51 and rearward direction 52 are horizontal directions, but the frontward direction 51 and rearward direction 52 may be directions that cross the gravitational direction. Further, a downward direction 53 is defined as the gravitational direction, and an upward direction 54 is defined as the direction opposite the gravitational direction. Further, a rightward direction 55 and a leftward direction 56 are defined as directions orthogonal to the frontward direction 51 and downward direction 53. More specifically, when the ink cartridge 30 is in its upright posture (the state illustrated in FIGS. 4-6), the rightward direction 55 is defined as the direction extending rightward and the leftward direction 56 as the direction extending leftward when the ink cartridge 30 is viewed from its rear side.

Further, in the following description, the frontward direction 51 and the rearward direction 52 may be collectively referred to as a front-rear direction. The upward direction 54 and the downward direction 53 may be collectively referred to as an up-down direction or a vertical direction. The rightward direction 55 and the leftward direction 56 may be collectively referred to as a left-right direction.

When the ink cartridge 30 is in its upright posture, the width direction of the ink cartridge 30 corresponds to the left-right direction, the height direction of the ink cartridge 30 corresponds to the vertical direction, and the depth direction of the ink cartridge 30 corresponds to the front-rear direction. Further, the direction in which the ink cartridge 30 is inserted relative to the cartridge-attachment section 110 corresponds to the front-rear direction in the preferred embodiment.

In the present disclosure, the term "facing forward" or "facing frontward" encompasses the meaning to face in a direction that includes a frontward component; the expression "facing rearward" encompasses the meaning to face in a direction that includes a rearward component; the expression "facing downward" encompasses the meaning to face in a direction that includes a downward component; the expression "facing upward" encompasses the meaning to face in a direction that includes an upward component; the expression "facing rightward" encompasses the meaning to face in a direction that includes a rightward component; and the expression "facing leftward" encompasses the meaning to face in a direction that includes a leftward component. For example, the phrase "the front surface faces frontward" may indicate that the front surface faces directly forward or that the front surface faces in a direction sloped relative to the frontward direction.

<Overview of Printer 10>

FIG. 1 illustrates a system 1 including a printer 10 and an ink cartridge 30. The printer 10 records images onto sheets based on an inkjet-recording system of selectively ejecting ink droplets. The printer 10 includes a recording head 21 (an example of a consuming portion), an ink-supplying device 100, and ink tubes 20 connecting the recording head 21 to the ink-supplying device 100. The ink-supplying device 100 is provided with a cartridge-attachment section 110. The ink cartridge 30 (an example of a liquid cartridge) can be attached in the cartridge-attachment section 110. An opening 112 is formed in one side of the cartridge-attachment section 110. While in its upright posture, the ink cartridge 30 is inserted into the cartridge-attachment section 110 through the opening 112 in a frontward direction to be attached in the cartridge-attachment section 110. The ink cartridge 30 can also be detached from the cartridge-attachment section 110 in the rearward direction while in the upright posture.

The ink cartridge 30 stores ink (an example of liquid) that the printer 10 can use for printing. The ink tube 20 connects the ink cartridge 30 to the recording head 21 in the attached state, i.e., when the ink cartridge 30 is completely attached in the cartridge-attachment section 110. The recording head 21 is provided with a sub-tank 28 and nozzles 29. The sub-tank 28 temporarily holds ink to be supplied through the ink tube 20. The recording head 21 selectively ejects ink supplied from the sub-tank 28 through the nozzles 29 according to an inkjet-recording method. More specifically, the recording head 21 is provided with a head control board (not illustrated), and piezoelectric elements 29A corresponding one-on-one to the nozzles 29. The head control board selectively applies drive voltages to the piezoelectric elements 29A in order to selectively eject ink from the nozzles 29. Hence, the recording head 21 consumes ink stored in the ink cartridge 30 that is attached in the cartridge-attachment section 110.

The printer 10 further includes a sheet tray 15, a sheet feeding roller 23, a conveying path 24, a pair of conveying rollers 25, a platen 26, a pair of discharge rollers 27, and a sheet discharge tray 16. The sheet feeding roller 23 feeds sheets from the sheet tray 15 onto the conveying path 24, and the conveying rollers 25 convey the sheets over the platen 26. The recording head 21 selectively ejects ink onto the sheets as the sheets passes over the platen 26, whereby an image is recorded on the sheets. The discharge rollers 27 receive sheets that have passed over the platen 26 and discharge the sheets to the sheet discharge tray 16 provided on the downstream end of the conveying path 24.

<Ink-Supplying Device 100>

As illustrated in FIG. 1, the ink-supplying device 100 is provided in the printer 10. The ink-supplying device 100 functions to supply ink to the recording head 21. The ink-supplying device 100 includes the cartridge-attachment section 110 in which the ink cartridge 30 can be attached. Note that in FIG. 1 the ink cartridge 30 is illustrated in its fully attached state in the cartridge-attachment section 110, i.e., in its attached posture. Thus, the state illustrated in FIG. 1 is the attached state. In other words, the ink cartridge 30 is in its attached posture in the attached state. The ink cartridge 30 is also in the upright posture in the attached state.

<Cartridge-Attachment Section 110>

Figure 2:
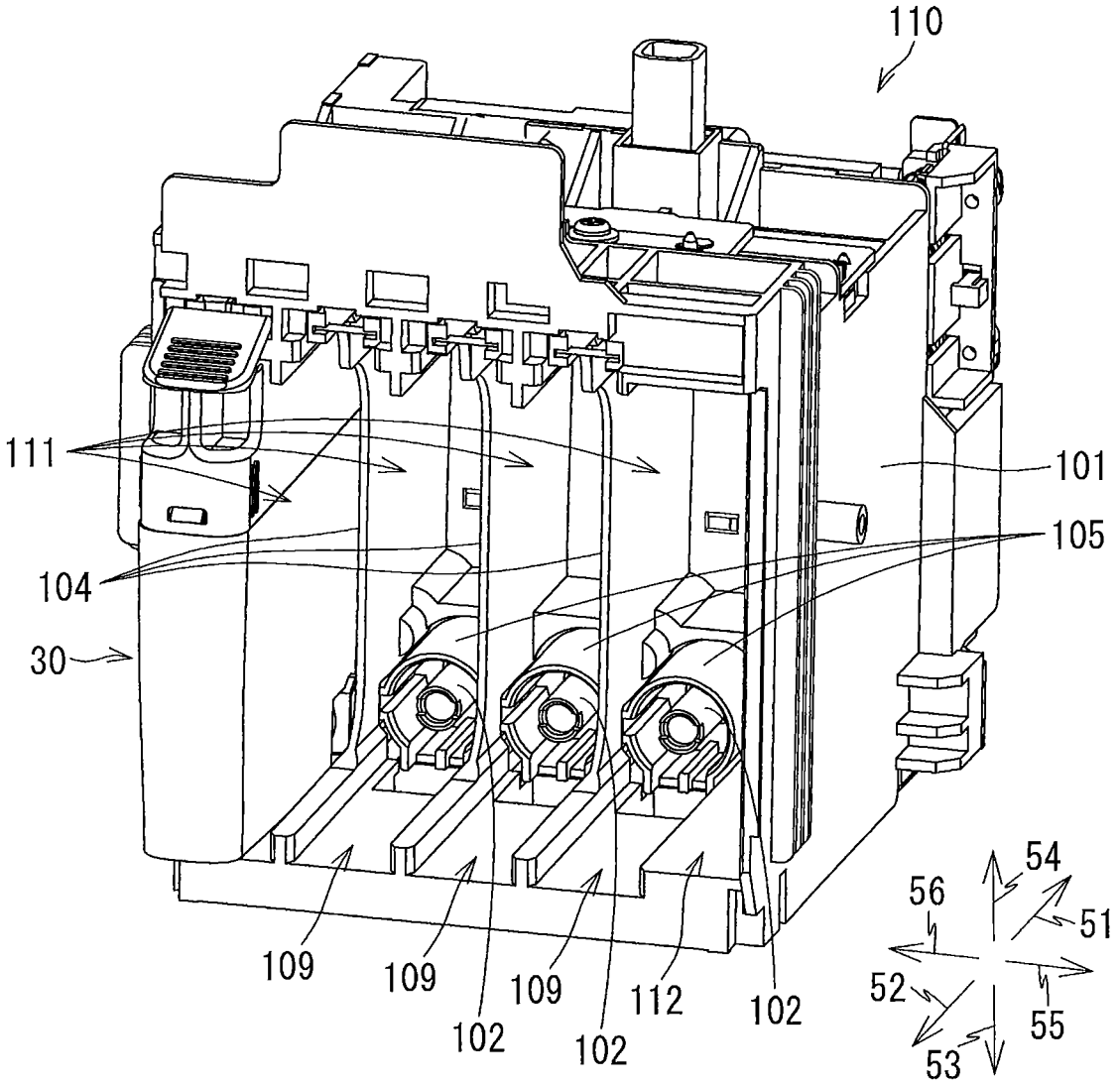
FIG. 2 is a perspective view showing an external appearance of the cartridge-attachment section according to the embodiment and an opening thereof.
Figure 3:
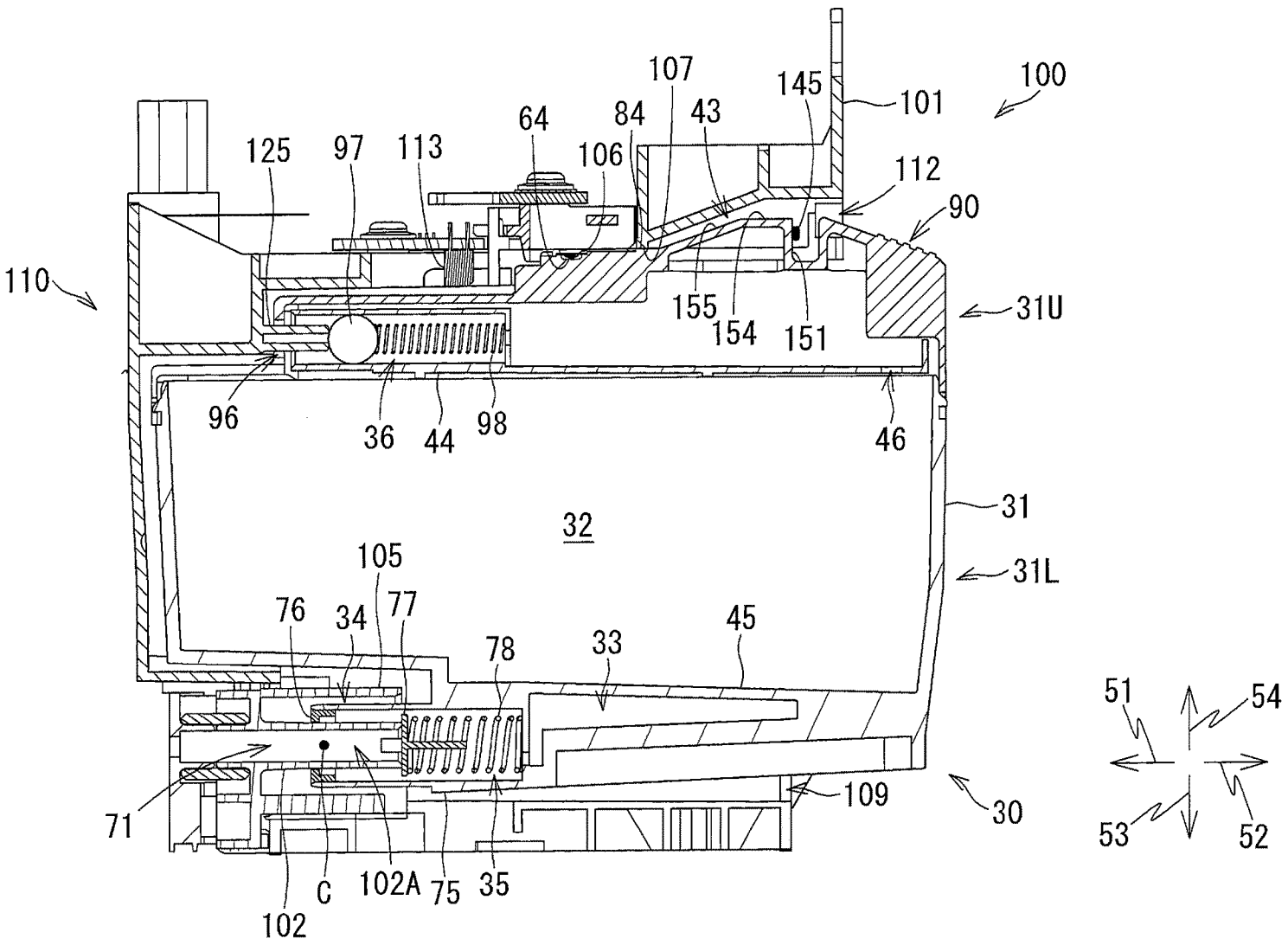
FIG. 3 is a vertical cross-sectional view of the cartridge-attachment section according to the embodiment, illustrating a state where the ink cartridge according to the embodiment is accommodated in the cartridge-attachment section.

As illustrated in FIGS. 1-3, the cartridge-attachment section 110 includes a case 101, ink needles 102 (examples of the ink delivery tubes), tanks 103, optical sensors 113, and contacts 106, as examples of an electrical contact. The cartridge-attachment section 110 can accommodate four ink cartridges 30 corresponding to the ink colors cyan, magenta, yellow, and black. Accordingly, the cartridge-attachment section 110 is provided with four each of the ink needles 102, tanks 103, optical sensors 113, and contacts 106 to correspond with the four ink cartridges 30.

<Case 101>

As illustrated in FIG. 2, the case 101 constitutes the housing of the cartridge-attachment section 110. The case 101 has a box shape with an inner top surface, an inner bottom surface, an inner front surface, and the opening 112 formed in the rear side. The inner top surface defines the tops of interior spaces 111 in the case 101. The inner bottom surface defines the bottoms of the interior spaces 111. The inner front surface defines the fronts of the interior spaces 111. The inner front surface connects the tops and bottoms of the interior spaces 111 in the case 101. The opening 112 is formed on the opposite side of the case 101 from the inner front surface relative to the front-rear direction. The opening 112 is exposed in the surface that the user faces when using the printer 10.

The ink cartridge 30 is inserted into one of the interior spaces 111 of the case 101 through the opening 112. The ink cartridge 30 is also extracted from the interior space 111 of the case 101 through the opening 112. Guide grooves 109 are formed in the bottom of the case 101. The ink cartridge 30 is guided along the front-rear direction when the bottom edge of the ink cartridge 30 is inserted into the corresponding guide groove 109. The case 101 also includes three plates 104. The plates 104 partition the interior of the case 101 into the four interior spaces 111 that are elongated vertically. The ink cartridges 30 are accommodated in the four interior spaces 111 partitioned by the plates 104.

<Ink Needle 102>

As illustrated in FIGS. 2 and 3, the ink needles 102 are tube-like members formed of resin. That is, the ink needles 102 are hollow. The ink needles 102 are positioned on the lower portion of the inner front surface constituting the case 101. The ink needles 102 are arranged at positions on the inner front surface corresponding to ink supply portions 34 of the ink cartridges 30 attached in the cartridge-attachment section 110. The ink needles 102 protrude rearward from the inner front surface of the case 101.

Both the rear end (distal end) and the front end (proximal end) of each ink needle 102 are open. The rear end of the ink needle 102 is inserted into an ink supply port 71 formed in the corresponding ink cartridge 30. The front end of the ink needle 102 is either directly or indirectly connected to the corresponding ink tube 20 (see FIG. 1). Accordingly, an interior space 102A of the ink needle 102 is in communication with the corresponding tank 103 and the recording head 21 via the interior space of the corresponding ink tube 20.

As illustrated in FIGS. 2 and 3, cylindrical shaped guide portions 105 are arranged around corresponding ink needles 102. The guide portions 105 protrude rearward from the inner front surface of the case 101. The protruding ends of the guide portions 105 are open. The ink needles 102 are arranged in the centers of the corresponding guide portions 105. The guide portions 105 have a shape that allows the ink supply portions 34 of the corresponding ink cartridges 30 to be inserted therein.

During the process of inserting an ink cartridge 30 frontward into the cartridge-attachment section 110, i.e., while the ink cartridge 30 is moving toward its attached posture, the ink supply portion 34 of the ink cartridge 30 is inserted into the guide portions 105 (see FIG. 3). As the ink cartridge 30 is inserted further into the cartridge-attachment section 110 in the frontward direction, the ink needle 102 is inserted from the front side into an ink valve chamber 35 of the ink cartridge 30 through the ink supply port 71 formed in the ink supply portion 34. Through this operation, the ink needle 102 is coupled with the ink supply portion 34, and the interior space 102A of the ink needle 102 is in communication with the ink valve chamber 35 formed in the ink supply portion 34. Ink stored in a second storage chamber 33 formed inside the ink cartridge 30 flows out of the storage chamber 33, through the ink valve chamber 35 and the interior space 102A of the ink needle 102, and into the tank 103 (see FIG. 1). Ink flowing out of the tank 103 passes through the ink tube 20 (an example of a channel) and into the recording head 21. The ink valve chamber 35 is an example of a liquid passage.

The distal end of the ink needle 102 may be flattened or pointed. The guide portions 105 may be formed in any shape or may be omitted from the cartridge-attachment section 110, provided that the ink cartridge 30 can be placed in the attached posture.

<Tank 103>

As illustrated in FIG. 1, the tanks 103 are provided on the front side of the case 101, described later. Each tank 103 has a box shape and can accommodate ink internally. The top portion of the tank 103 is open to the outside through an air communication port 124. Accordingly, the interior of the tank 103 is open to the atmosphere. The interior space in the tank 103 is in communication with the interior space 102A of the corresponding ink needle 102. With this arrangement, ink flowing out of the ink cartridge 30 passes through the ink needle 102 and is stored in the tank 103. The ink tube 20 is connected to the tank 103. Accordingly, ink stored in the interior of the tank 103 is supplied to the recording head 21 through the ink tube 20.

<Contacts 106>

As illustrated in FIG. 3, four of the contacts 106 are provided on the inner top surface of the case 101 inside corresponding interior spaces 111 (see FIG. 2). The four contacts 106 are provided to correspond with the four ink cartridges 30 that can be accommodated in the case 101.

The contacts 106 are positioned rearward relative to the ink needles 102. The contacts 106 protrude downward from the inner top surface of the case 101 into the corresponding interior spaces 111. The contacts 106 face downward. The contacts 106 are configured of electrically conductive and resilient members. The contacts 106 can resiliently deform upward. While not illustrated in detail in the drawings, the four contacts 106 provided in the interior spaces 111 are aligned in the left-right direction and are spaced at intervals in the same direction. The arrangement of the four contacts 106 corresponds to the arrangement of four sets of electrodes 65 on the ink cartridges 30 described later. Note that the numbers of contacts 106 and sets of electrodes 65 is arbitrary.

The contacts 106 are electrically connected to a controller 11 (see FIG. 1) in the printer 10 via an electric circuit. The controller 11 includes a CPU, ROM, and RAM, for example. By placing a contact 106 in contact with the corresponding electrodes 65 so that electricity can be conducted therebetween, a voltage Vc is applied to the electrodes 65, the electrodes 65 are grounded, and power is supplied to the electrodes 65. Further, when electricity can be conducted between the contact 106 and corresponding electrodes 65, data stored in an integrated circuit of the ink cartridge 30 is accessible. Output from the electric circuit is inputted into the controller 11.

<Rods 125>

As illustrated in FIG. 3, rods 125 are formed on the inner front surface of the case 101 above the corresponding ink needles 102. The rods 125 protrude rearward from the inner front surface of the case 101. The rods 125 are cylindrical in shape. In the attached state, i.e., when the ink cartridge 30 is in the attached posture, the corresponding rod 125 is inserted through an air communication port 96 described later.

<Optical Sensor 113>

As illustrated in FIG. 3, the optical sensors 113 are disposed on the inner top surface of the case 101. The optical sensors 113 are positioned rearward relative to the rods 125 and frontward relative to the contacts 106. Each optical sensor 113 is provided with a light-emitting portion and a light-receiving portion. The light-emitting portion is disposed on the right or left of the light-receiving portion with a gap formed therebetween. A light-blocking plate 67 (see FIG. 4) on the ink cartridge 30 is positioned between the corresponding light-emitting portion and light-receiving portion when the ink cartridge 30 is fully attached in the cartridge-attachment section 110. That is, the light-emitting portion and light-receiving portion are arranged on opposing sides of the light-blocking plate 67 of a corresponding ink cartridge 30 that is fully attached in the cartridge-attachment section 110. The light-blocking plate 67 is an example of a light-blocking portion.

The optical sensors 113 output detection signals to the controller 11 (see FIG. 1) that differ according to whether the corresponding light-receiving portion receives light emitted from the light-emitting portion in the left-right direction. For example, the optical sensor 113 outputs a low level signal to the controller 11 when the light-receiving portion cannot receive light emitted from the light-emitting portion (that is, when the received light is less than a prescribed intensity) and outputs a high level signal to the controller 11 when the light-receiving portion can receive light emitted from the light-emitting portion (that is, when the received light is greater than or equal to the prescribed intensity).

<Lock Shaft 145>

As illustrated in FIG. 3, a lock shaft 145 (an example of an engagement portion) extends in the left-right direction of the case 101 near the inner top surface of the case 101 and near the opening 112. The lock shaft 145 is positioned rearward relative to the contacts 106. The lock shaft 145 is a rod-shaped member that is elongated in the left-right direction. The lock shaft 145 is a metal column, for example. The left and right ends of the lock shaft 145 are fixed in the walls defining the left and right sides of the case 101. Therefore, the lock shaft 145 does not rotate or otherwise move relative to the case 101. The lock shaft 145 extends in the left-right direction through all four interior spaces 111 that can accommodate ink cartridges 30. Space is also provided around the lock shaft 145 in each of the interior spaces 111 that accommodates an ink cartridge 30. Hence, the ink cartridge 30 can access to the lock shaft 145 from below and from the front side.

The lock shaft 145 functions to retain the ink cartridge 30 in its attached posture when the ink cartridge 30 is attached in the cartridge-attachment section 110. When the user inserts the ink cartridge 30 into the cartridge-attachment section 110 and rotates the ink cartridge 30 from its second posture illustrated in FIG. 8 to its first posture illustrated in FIG. 3, the ink cartridge 30 engages with the lock shaft 145. Through this operation, the lock shaft 145 retains the ink cartridge 30 in the cartridge-attachment section 110 against the force of coil springs 78 and 98 provided in the ink cartridge 30 that pushes the ink cartridge 30 rearward. Note that the ink cartridge 30 in the first posture is in the upright posture.

<Positioning Portion 107>

As illustrated in FIG. 3, a positioning portion 107 is provided near the inner top surface of the case 101. The positioning portion 107 is disposed between the contacts 106 and the lock shaft 145 with respect to the front-rear direction. The positioning portion 107 is a protrusion that protrudes downward from the inner top surface of the case 101. The positioning portion 107 is formed integrally with the case 101. The surface on the bottom of the positioning portion 107 can contact a contact surface 84 on the ink cartridge 30. The bottom surface of the positioning portion 107 is positioned slightly above the bottoms of the contacts 106.

<Ink Cartridge 30>

Figure 4:
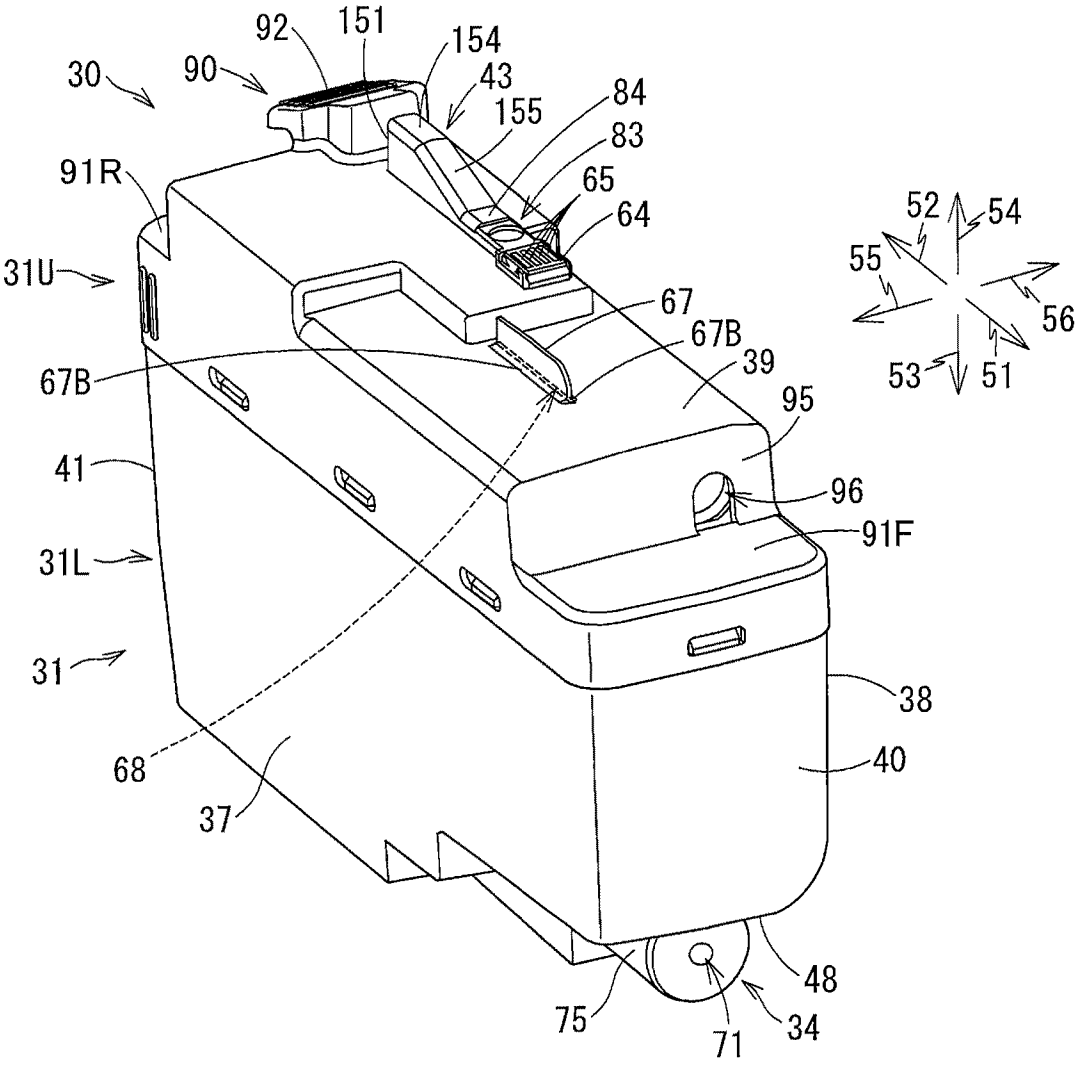
FIG. 4 is a perspective view of the ink cartridge according to the embodiment as viewed from its front side.
Figure 5:
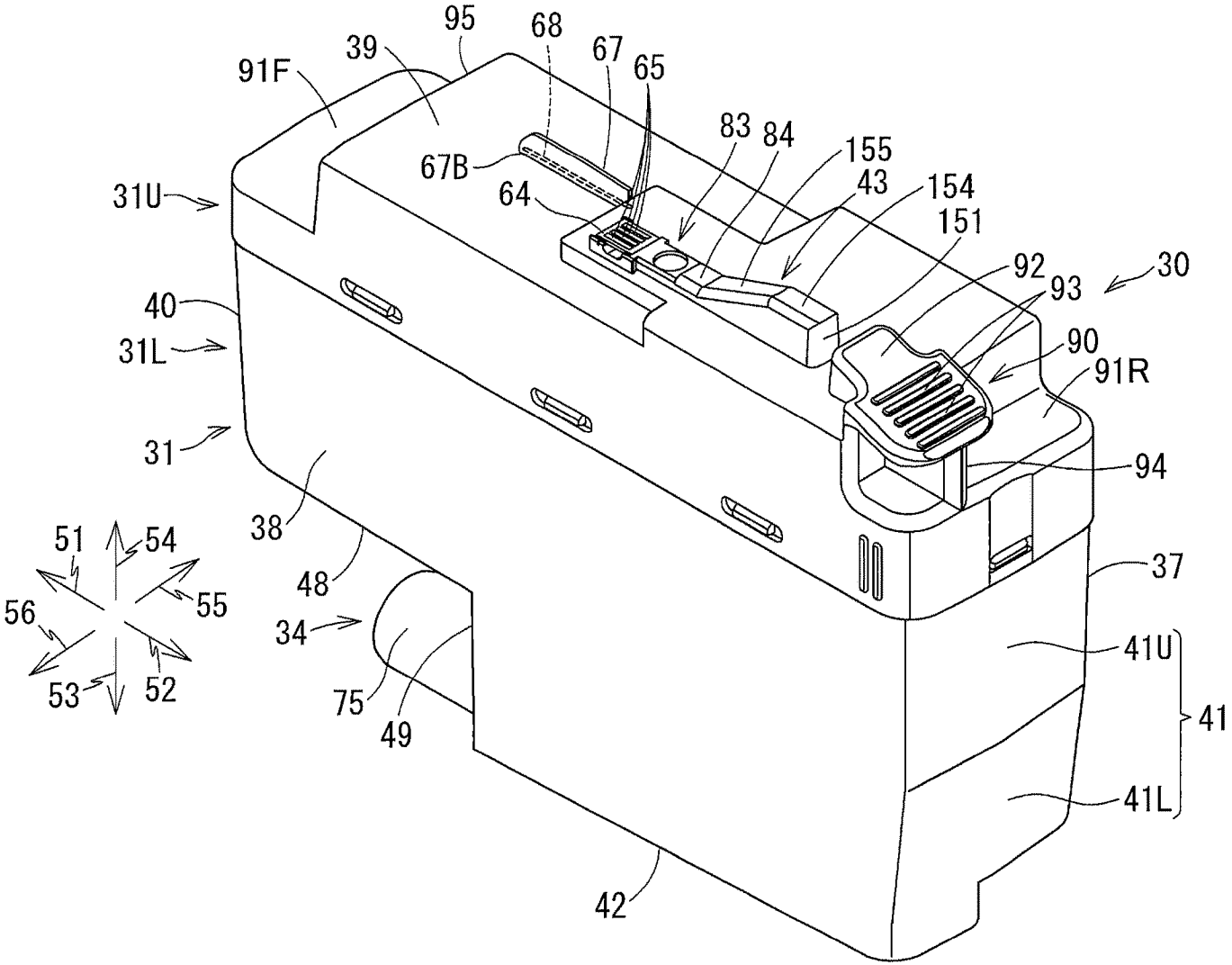
FIG. 5 is a perspective view of the ink cartridge according to the embodiment as viewed from its rear side.
Figure 6B:
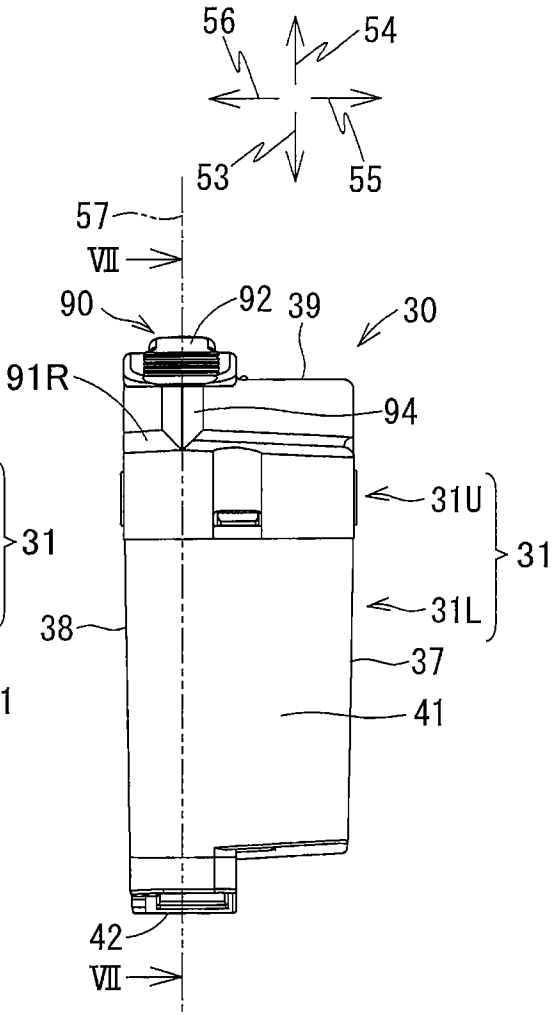
FIG. 6B is a rear side view of the ink cartridge according to the embodiment.
Figure 6A:
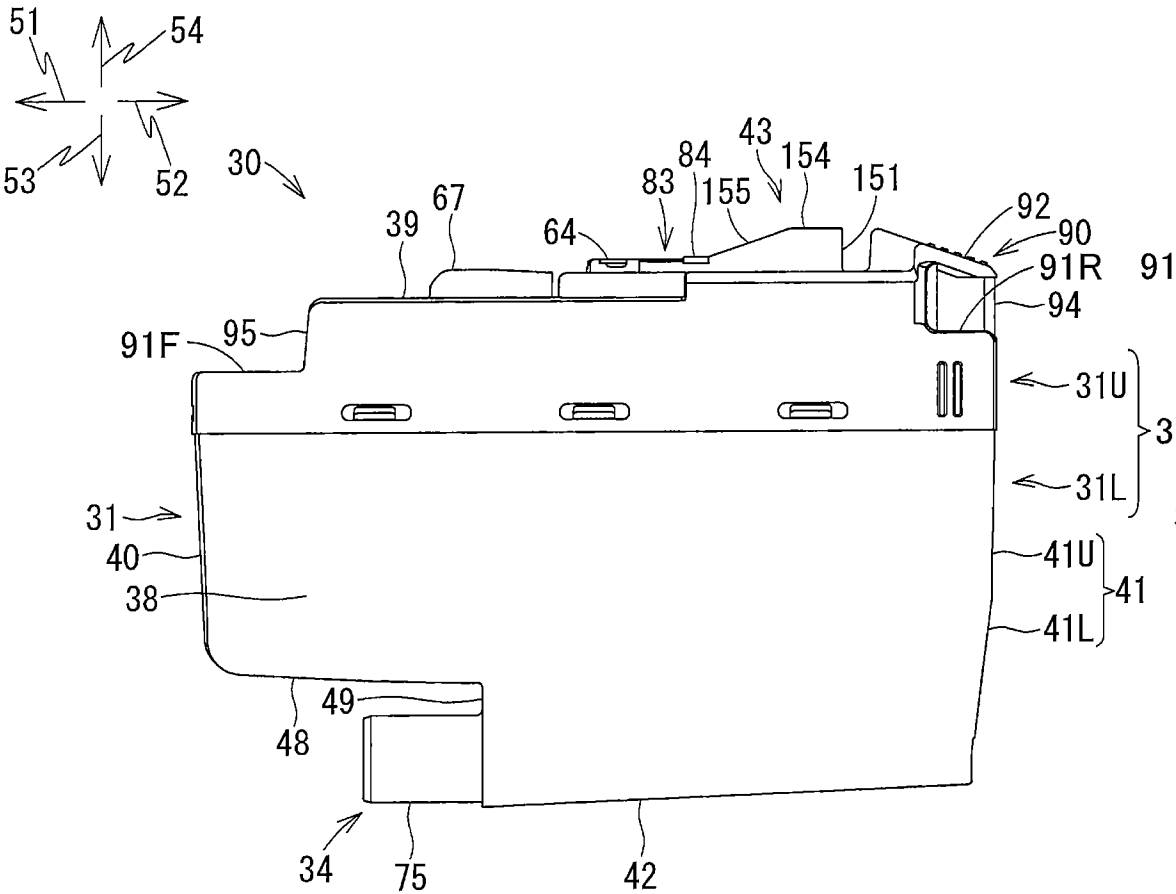
FIG. 6A is a right side view of the ink cartridge according to the embodiment.

The ink cartridge 30 illustrated in FIGS. 4-6 is a container that stores ink. In FIGS. 4-6, the ink cartridge 30 is in its upright posture. As will be described later, the ink cartridge 30 has a cartridge body 31 (an example of a casing) that includes a front wall 40, a rear wall 41, a top wall 39, a bottom wall 42, and a pair of side walls 37 and 38. In the attached state, the direction from the rear wall 41 to the front wall 40 is equivalent to the frontward direction 51, the direction from the front wall 40 to the rear wall 41 is equivalent to the rearward direction 52, the direction from the top wall 39 to the bottom wall 42 is equivalent to the downward direction 53, the direction from the bottom wall 42 to the top wall 39 is equivalent to the upward direction 54, the direction from the side wall 38 to the side wall 37 is equivalent to the rightward direction 55, and the direction from the side wall 37 to the side wall 38 is equivalent to the leftward direction 56. Also in the attached state, the front surface of the front wall 40 faces frontward, the rear surface of the rear wall 41 faces rearward, the bottom surface of the bottom wall 42 faces downward, the top surface of the top wall 39 faces upward, the right surface of the side wall 37 faces rightward, and the left surface of the side wall 38 faces leftward.

In the following description of the ink cartridge 30, the up, down, front, rear, left, and right directions relative to the ink cartridge 30 are defined based on the attached state, i.e., when the ink cartridge 30 is in its upright posture.

As described above, the ink cartridge 30 has the cartridge body 31. The cartridge body 31 has a general rectangular parallelepiped shape. In the preferred embodiment, the cartridge body 31 has a lower case 31L, and an upper cover 31U. The lower case 31L is provided internally with a first storage chamber 32 and a second storage chamber 33 (see FIG. 7) for storing ink. The upper cover 31U is positioned above the lower case 31L. The upper cover 31U is fitted onto the lower case 31L.

The cartridge body 31 has an overall flattened shape in which its left-right dimension is narrow and its vertical and front-rear dimensions are greater than the left-right dimension.

The cartridge body 31 is provided with a front wall 40, rear wall 41, top wall 39, bottom wall 42, and pair of side walls 37 and 38. The front wall 40 and rear wall 41 are separated from each other in the front-rear direction. The top wall 39 and bottom wall 42 are separated from each other vertically. The side walls 37 and 38 are separated from each other in the left-right direction. The top wall 39 and bottom wall 42 are formed between the front wall 40 and rear wall 41 in the front-rear direction. The side walls 37 and 38 are formed between the front wall 40 and rear wall 41 in the front-rear direction and between the top wall 39 and bottom wall 42 in the vertical direction. Each of the front wall 40, rear wall 41, top wall 39, bottom wall 42, and side walls 37 and 38 define at least one of the first storage chamber 32, second storage chamber 33, or an air valve chamber 36.

At least the rear wall 41 of the cartridge body 31 forming the lower case 31L is translucent so that the levels of ink stored in the storage chambers 32 and 33 are visible from the outside.

Note that while the outer surface of the cartridge body 31 is configured of the lower case 31L and the upper cover 31U, the cartridge body 31 may be configured of a single box-shaped case. Further, the cartridge body 31 may include an inner case defining the storage chambers, and an outer case constituting the outer wall that are arranged in a nested configuration with the inner case accommodated inside the outer case.

As illustrated in FIG. 6, the rear surface of the rear wall 41 includes an upper portion 41U and a lower portion 41L. The upper portion 41U is positioned above the lower portion 41L. The lower portion 41L is positioned frontward related to the upper portion 41U. Both the upper portion 41U and lower portion 41L are flat surfaces. The upper portion 41U and lower portion 41L extend in directions that intersect but are not orthogonal to each other. From the upper portion 41U to the bottom wall 42, the lower portion 41L slopes relative to the vertical direction so as to grow closer to the front wall 40.

The bottom surface of the bottom wall 42 is sloped relative to the front-rear direction so that its front end is positioned lower than its rear end. The bottom surface of the bottom wall 42 preferably slopes at an angle within a range from 2 degrees to 4 degrees to the horizontal direction. The front end of the bottom wall 42 is positioned frontward related to a locking surface 151 described later. The rear edge of the bottom wall 42 is connected to the bottom edge of the lower portion 41L constituting the rear wall 41.

The cartridge body 31 also has a sub-bottom wall 48. The sub-bottom wall 48 is positioned upward relative to the bottom wall 42. The sub-bottom wall 48 extends continuously rearward from the bottom edge of the front wall 40. The cartridge body 31 also has a sub-front wall 49 that connects the bottom wall 42 to the sub-bottom wall 48. The ink supply portion 34 extends frontward from the sub-front wall 49 below the sub-bottom wall 48 and above the bottom wall 42. Note that the position of the front edge of the sub-bottom wall 48 is arbitrary. For example, the front edge of the sub-bottom wall 48 may be positioned rearward related to the front edge of the ink supply portion 34. The front edge of the sub-bottom wall 48 is positioned frontward relative to the front edge of the ink supply portion 34, and the rear edge of the sub-bottom wall 48 is positioned rearward relative to the front edge of the ink supply portion 34.

The front wall, rear wall, top wall, bottom wall, and side walls of the ink cartridge 30 need not each be configured of a single wall. For example, the sub-front wall 49 and a sub-front wall 95 described later constitute the front wall of the ink cartridge 30 together with the front wall 40 in the preferred embodiment. Further, the sub-bottom wall 48 constitutes the bottom wall of the ink cartridge 30 together with the bottom wall 42. Similarly, sub-top walls 91F, 91R described later (see FIG. 6) constitute the top wall of the ink cartridge 30 together with the top wall 39.

In addition, the front surface of the front wall 40, rear surface of the rear wall 41, top surface of the top wall 39, bottom surface of the bottom wall 42, right surface of the side wall 37, and left surface of the side wall 38 constituting the ink cartridge 30 need not be formed as single flat surfaces.

When the ink cartridge 30 is in its upright posture, the front surface of the front wall 40 is visible when viewing the ink cartridge 30 from the front side and is positioned frontward of the front-rear center portion of the ink cartridge 30. In the preferred embodiment, the front surface of the sub-front wall 49 connecting the bottom wall 42 to the sub-bottom wall 48 may be considered part of the front surface of the front wall together with the front surface of the front wall 40 connecting the sub-bottom wall 48 to the top wall 39. As an alternative, the sub-bottom wall 48 may be omitted from the ink cartridge 30, and the front surface of the front wall 40 may constitute a single surface continuously connecting the top wall 39 to the bottom wall 42.

When the ink cartridge 30 is in its upright posture, the rear surface of the rear wall 41 is the surface visible when viewing the ink cartridge 30 from the rear side and is positioned rearward relative to the front-rear center portion of the ink cartridge 30.

When the ink cartridge 30 is in its upright posture, the top surface of the top wall 39 is the surface visible when viewing the ink cartridge 30 from above and is positioned above the vertical center of the ink cartridge 30.

When the ink cartridge 30 is in its upright posture, the bottom surface of the bottom wall 42 is the surface that is visible when viewing the ink cartridge 30 from below and is positioned lower than the vertical center of the ink cartridge 30.

When the ink cartridge 30 is in its upright posture, the right surface of the side wall 37 is the surface visible when viewing the ink cartridge 30 from the right side and is positioned rightward relative to the left-right center of the ink cartridge 30.

When the ink cartridge 30 is in its upright posture, the left surface of the side wall 38 is the surface that is visible when viewing the ink cartridge 30 from the left side and is positioned leftward relative to the left-right center of the ink cartridge 30.

<Protrusion>

As illustrated in FIGS. 4-6, a protruding portion 43 and an operation portion 90 are provided on the top wall 39 of the cartridge body 31. The operation portion 90 is disposed on the top wall 39 to the rear of a locking surface 151 (an example of an engaging surface). The protruding portion 43 is an example of a protrusion.

The protruding portion 43 extends in the front-rear direction. The surface of the protruding portion 43 facing rearward is the locking surface 151. The locking surface 151 is positioned above the top wall 39. The locking surface 151 extends along the vertical direction. The locking surface 151 is positioned to contact the lock shaft 145 in a rearward direction when the ink cartridge 30 is attached in the cartridge-attachment section 110. Contact between the locking surface 151 and lock shaft 145, i.e., the engagement of the locking surface 151 and lock shaft 145, hold the ink cartridge 30 in the cartridge-attachment section 110 against the urging force of the coil springs 78 and 98. Note that while the locking surface 151 is a surface that intersects the front-rear direction (direction of insertion) in the preferred embodiment, the present disclosure is not limited to this arrangement. For example, the locking surface may extend horizontally in the front-rear direction and may contact the locking shaft from below in the attached state. In this case, it is necessary to generate frictional force between the lock shaft 145 and the locking surface to oppose the urging force of the coil springs 78 and 98. If this frictional force is sufficient to retain the ink cartridge 30 in the cartridge-attachment section 110, the locking surface may be configured of a horizontal surface.

The protruding portion 43 also includes a horizontal surface 154 that extends continuously frontward from the locking surface 151. The horizontal surface 154 extends in both the left-right and front-rear directions. The protruding portion 43 also includes an inclined surface 155 that slopes continuously downward and frontward from the horizontal surface 154. The inclined surface 155 preferably slopes at an angle within a range from 15 degrees to 25 degrees with respect to the horizontal direction. Since the locking surface 151 and inclined surface 155 are connected via the horizontal surface 154, the boundary between the locking surface 151 and inclined surface 155 is not formed as a sharp angle. The inclined surface 155 is positioned between the locking surface 151 and a circuit board 64 described later in the front-rear direction. When the ink cartridge 30 is being inserted into the cartridge-attachment section 110, the lock shaft 145 in the cartridge-attachment section 110 contacts the inclined surface 155 and horizontal surface 154 and is smoothly guided by the inclined surface 155 and horizontal surface 154 to a position rearward of the locking surface 151.

Sub-top walls 91F, 91R are formed on both the front and rear ends of the top wall 39. The sub-top walls 91F, 91R are positioned lower than the front-rear center portion of the top wall 39. The operation portion 90 is disposed above the sub-top wall 91R positioned on the rear end of the top wall 39 and is separated from the sub-top wall 91R. The operation portion 90 has a flat plate shape that protrudes upward from a position near the border between the top wall 39 and sub-top wall 91R to a height approximately equal to the height of the protruding portion 43 in the upright posture, and then bends and extends in a direction sloping downward and rearward. A rib 94 is provided between the operation portion 90 and sub-top wall 91R. The rib 94 is formed continuously between the operation portion 90 and sub-top wall 91R and extends rearward. The left-right dimension of the rib 94 is smaller than the left-right dimensions of the operation portion 90 and sub-top wall 91R.

The surface of the operation portion 90 facing obliquely upward and rearward constitutes an operating surface 92. The operating surface 92 and sub-top wall 91R occupy overlapping positions in the front-rear direction. That is, the operating surface 92 is in a position overlapping the sub-top wall 91R when the ink cartridge 30 is viewed from above. In other words, a virtual plane extending in the vertical and left-right directions passes through both the operating surface 92 and sub-top wall 91R.

A plurality of protrusions 93 is formed on the operating surface 92. The protrusions 93 are spaced at intervals in the front-rear direction. The protrusions 93 enable the user to easily recognize the operating surface 92 by feel and reduce the likelihood that the user's finger will slip off the operating surface 92 when the user operates the operating surface 92.

The operating surface 92 is visible when viewing the ink cartridge 30 from above and when viewing the ink cartridge 30 from the rear. When the ink cartridge 30 is retained in its attached posture in the cartridge-attachment section 110, the operating surface 92 is the surface that the user operates in order to remove the ink cartridge 30 from the cartridge-attachment section 110. Note that the operation portion 90 is integrally molded with the cartridge body 31 or otherwise fixed to the same so that the operation portion 90 does not rotate or otherwise move relative to the cartridge body 31. Hence, the force that the user applies to the operating surface 92 is directly transferred to the cartridge body 31 without a change in direction.

<Protruding Portion 83>

As illustrated in FIGS. 4-6, a protruding portion 83 is provided on the top surface of the top wall 39 in front of the protruding portion 43. The protruding portion 83 is disposed in the same left-right position as the protruding portion 43 and extends continuously frontward from the front end of the protruding portion 43. The top surface of the protruding portion 83 constitutes a contact surface 84. The contact surface 84 is formed continuously with the bottom edge of the inclined surface 155 and faces upward. The contact surface 84 is positioned between a circuit board 64 described later and the locking surface 151 in the front-rear direction.

As illustrated in FIG. 3, the contact surface 84 contacts the positioning portion 107 from below during the attached state and functions as a reference for positioning the ink cartridge 30 vertically. The contact surface 84 is formed as an integral member with the upper cover 31U. Note that the structure of the inclined surface 155 is arbitrary and need not be configured as a continuous surface between the contact surface 84 and locking surface 151. For example, the protruding portion 83 having the contact surface 84, and the protruding portion 43 having the locking surface 151 may each protrude upward, non-continuously and independent of each other.

<Light-Blocking Plate 67>

As indicated by the dashed line in FIG. 4, an opening 68 is formed in the top surface of the top wall 39. The opening 68 is elongated in the front-rear direction. The light-blocking plate 67 is attached in the opening 68.

The light-blocking plate 67 is formed of a resiliently deformable synthetic polymer, such as a rubber, elastomer, or silicone. In the preferred embodiment, the light-blocking plate 67 includes a color material capable of absorbing light (a black pigment such as carbon black, for example).

Figure 7:
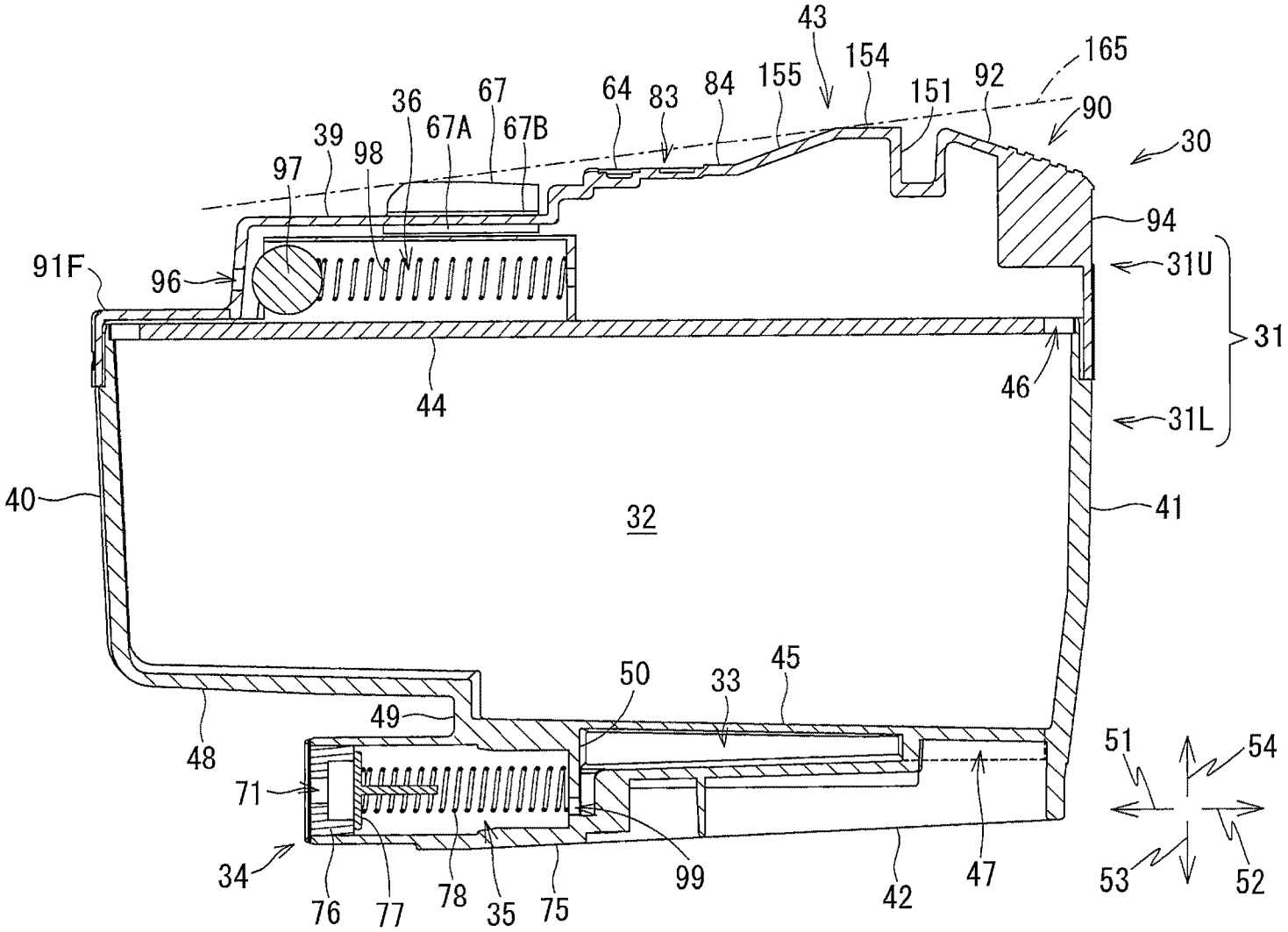
FIG. 7 is a cross-sectional view of the ink cartridge according to the embodiment taken along a plane VII-VII shown in FIG. 6B.

In the preferred embodiment, the light-blocking plate 67 is attached on the top wall 39 as described below. As illustrated in FIGS. 4, 5, and 7, a pair of first ribs 67A and a pair of second ribs 67B are attached to the light-blocking plate 67. One of the first ribs 67A and one of the second ribs 67B protrude rightward from the right surface of the light-blocking plate 67, and the other first rib 67A and the other second rib 67B protrude leftward from the left surface of the light-blocking plate 67. The second ribs 67B are positioned above the first ribs 67A. As described above, the light-blocking plate 67 is configured of a resiliently deformable synthetic polymer. Hence, the light-blocking plate 67 is attached on the top wall 39 by interposing the top wall 39 between the first ribs 67A and the second ribs 67B, as illustrated in FIG. 7. Note that the present disclosure is not limited to this configuration for mounting the light-blocking plate 67 on the top wall 39. The light-blocking plate 67 may be attached on the top wall 39 according to another well-known configuration. For example, rather than interposing the top wall 39 between the first ribs 67A and second ribs 67B, the light-blocking plate 67 may be fixed to the top wall 39 via an adhesive or the like.

As illustrated in FIGS. 4-6, the light-blocking plate 67 protrudes upward from the top surface of the top wall 39. The light-blocking plate 67 is positioned frontward relative to the protruding portion 83. The light-blocking plate 67 is also positioned frontward and downward relative to the circuit board 64.

The left-right dimension of the light-blocking plate 67 is shorter than the left-right dimension of the top surface of the cartridge body 31. The front-rear dimension of the light-blocking plate 67 is shorter than the front-rear dimension of the top surface of the cartridge body 31. The light-blocking plate 67 is elongated in the front-rear direction. The light-blocking plate 67 has a plate shape with a narrow dimension in the left-right direction, and dimensions in the vertical and front-rear directions that are greater than the left-right dimension.

When the ink cartridge 30 is in its upright posture, the light-blocking plate 67 blocks light emitted from the optical sensor 113 that travels in the left-right direction. More specifically, light outputted from the light-emitting portion of the optical sensor 113 is incident on the light-blocking plate 67 before reaching the light-receiving portion. Consequently, the intensity of light that reaches the light-receiving portion is less than a prescribed intensity, such as 0 (zero). The light-blocking plate 67 may either block or attenuate light traveling from the light-emitting portion to the light-receiving portion. Alternatively, the light-blocking plate 67 may be configured to redirect light traveling from the light-emitting portion toward the light-receiving portion onto a different path.

Figure 9:
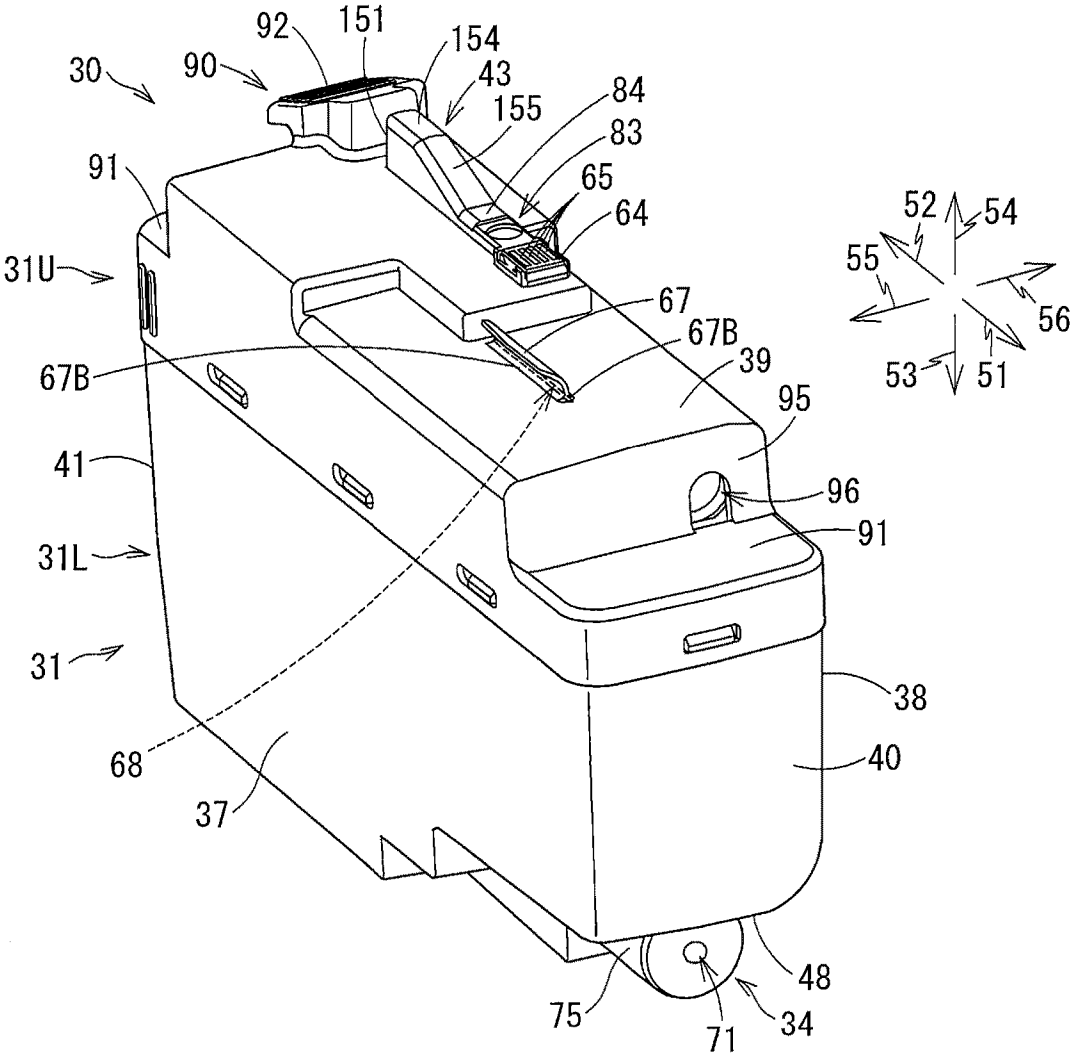
FIG. 9 is a perspective view of the ink cartridge according to the embodiment as viewed from its front side, in a state where a light-blocking plate bends rightward.
Figure 10:
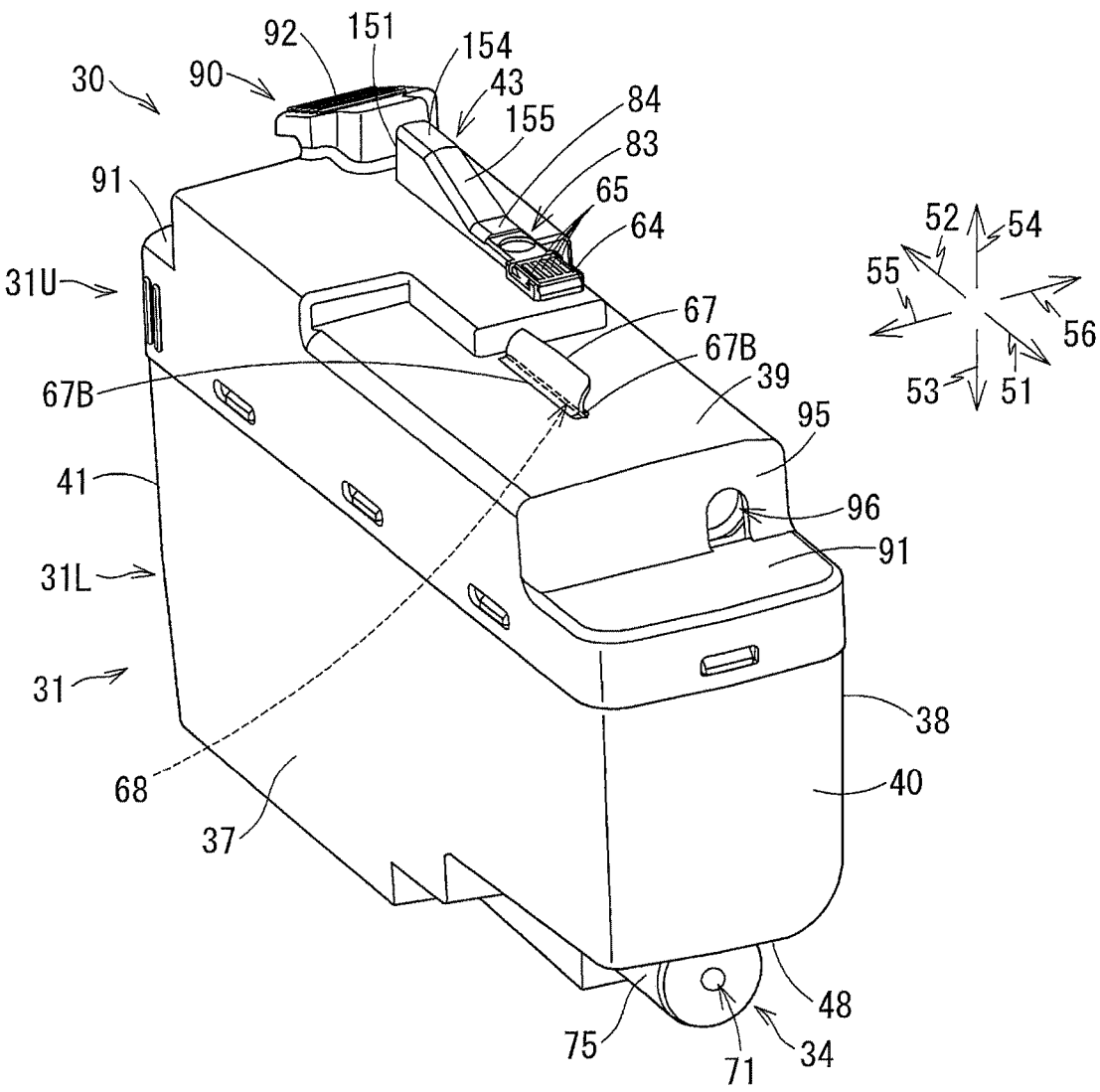
FIG. 10 is a perspective view of the ink cartridge according to the embodiment as viewed from its front side, in a state where the light-blocking plate bends leftward.

In the preferred embodiment, the light-blocking plate 67 is formed of a flexible material and has a narrow left-right dimension. Therefore, the light-blocking plate 67 easily bends in the left-right direction. When no external force is applied to the light-blocking plate 67, the light-blocking plate 67 extends straight in the vertical and front-rear directions, as illustrated in FIG. 4. When force is applied to the light-blocking plate 67 from the left side, the light-blocking plate 67 bends rightward, as illustrated in FIG. 9. Similarly, when force is applied to the light-blocking plate 67 from the right side, the light-blocking plate 67 bends leftward, as illustrated in FIG. 10.

The light-blocking plate 67 is resilient. In other words, when a force applied to the light-blocking plate 67 is removed, the light-blocking plate 67 returns to its original state, i.e. non-deformed state, prior to the force being applied. Specifically, after the force applied to the light-blocking plate 67 in either FIG. 9 or 10 is removed, the light-blocking plate 67 returns to the non-deformed state illustrated in FIG. 4.

Note that when a force applied to the light-blocking plate 67 is removed, the light-blocking plate 67 need not return completely to its original state before the force was applied. That is, when the applied force is removed, the light-blocking plate 67 should be capable of returning to a shape sufficient for blocking or attenuating light outputted from the optical sensor 113. Specifically, at least in the non-deformed state, the light-blocking plate 67 is configured to block or attenuate light emitted from the optical sensor 113 that travels in the widthwise direction in the upright posture.

As described above, the light-blocking plate 67 is deformable by an external force and capable of returning to a shape for blocking or attenuating light when the external force is removed.

<Air Communication Port 96>

As illustrated in FIG. 4, a sub-front wall 95 extends upward from the rear edge of the sub-top wall 91F provided on the front end of the top surface of the top wall 39. The sub-front wall 95 faces forward. An air communication port 96 is formed in the sub-front wall 95. The air communication port 96 is provided above the vertical center of the cartridge body 31. The air communication port 96 is a substantially circular opening formed in the sub-front wall 95. The inner diameter of the air communication port 96 is larger than the outer diameter of the rods j provided in the cartridge-attachment section 110 (see FIG. 3).

As illustrated in FIG. 3, as the ink cartridge 30 is attached in the cartridge-attachment section 110, the corresponding rod 125 is inserted through the air communication port 96, as illustrated in FIG. 3. The rod 125 inserted through the air communication port 96 moves a valve 97 for sealing the air communication port 96 rearward against the urging force of the coil spring 98. When the valve 97 moves rearward away from the air communication port 96, the first storage chamber 32 is opened to the atmosphere. Note that the member sealing the air communication port 96 is not restricted to the valve 97. For example, the air communication port 96 may be closed with a seal that can be peeled off the sub-front wall 95.

<Circuit Board 64>

As illustrated in FIGS. 4-6, a circuit board 64 is provided on the top of the protruding portion 83. The circuit board 64 is provided rearward relative to the light-blocking plate 67 and forward relative to the retaining part (the protruding portion 43). Hence, the circuit board 64 is disposed between the light-blocking plate 67 and the retaining part in the front-rear direction. The circuit board 64 is disposed frontward of the contact surface 84. The circuit board 64 is arranged to face upward when the ink cartridge 30 is in the upright posture. The circuit board 64 is a plate that extends in the left-right and front-rear directions when the ink cartridge 30 is in the upright posture.

The circuit board 64 is disposed in a recessed space positioned on the front side of the contact surface 84 that is recessed downward in the protruding portion 83. The circuit board 64 is supported by the protruding portion 83 from below. While not illustrated in detail in the drawings, the recessed space in the protruding portion 83 is filled with a photopolymer for bonding the circuit board 64 to the protruding portion 83. Note that the circuit board 64 may be bonded to the protruding portion 83 using an adhesive rather than a photopolymer or may be attached in the protruding portion 83 through a fitting process or method other than bonding.

As illustrated in FIG. 3, the circuit board 64 contacts and becomes electrically connected to the contact 106 during the process of inserting the ink cartridge 30 into the cartridge-attachment section 110. This contact and electrical connection with the contact 106 is maintained when the ink cartridge 30 is in its attached state in the cartridge-attachment section 110.

As illustrated in FIG. 5, the circuit board 64 is formed by mounting a chip (not illustrated in the drawings) and four electrodes 65 on a substrate made from a silicone or glass epoxy, for example. Note that the circuit board 64 may also be a flexible printed circuit board.

The chip is a semiconductor integrated circuit. Information related to the ink cartridge 30 can be stored on and read from the chip. The information related to the ink cartridge 30 is data specifying the lot number, manufactured date, ink colors used, and the like.

Each electrode 65 is electrically connected to the chip. Each electrode 65 extends along the front-rear direction. The electrodes 65 are juxtaposed in the left-right direction on the top surface of the circuit board 64 and are spaced apart from one another. Each electrode 65 is exposed on the top surface of the circuit board 64 so as to be electrically accessible.

As illustrated in FIG. 7, the circuit board 64 is positioned below a virtual line 165 (an example of a cross section of an imaginary plane) depicted by a one-dot chain line in FIG. 7. The virtual line 165 is the highest of virtual lines extending in the left-right direction that pass through both a protrusion (the protruding portion 43 or the operation portion 90) and the light-blocking plate 67. In the preferred embodiment, the virtual line 165 passes through the top side of the protruding portion 43 and a point near the top of the light-blocking plate 67. Naturally, the position and direction of the virtual line 165 can be modified based on the positions and shapes of the retaining part and the light-blocking plate 67.

In other words, the protrusion and the light-blocking plate 67 defines a plurality of imaginary planes each of which passes through the protrusion and the light blocking plate 67. Each of the plurality of imaginary planes horizontally extending in the left-right direction, and the plurality of imaginary planes include a specific imaginary plane defined by the protrusion and the light-blocking plate 67. The specific imaginary plane is positioned higher than any other imaginary plane between the protrusion and the light blocking plate 67 in the upright posture. The circuit board 64 is positioned downward relative to the specific imaginary plane in the gravitational direction in the upright posture. Here, the virtual line 165 can be defied as a cross section of the specific imaginary plane taken along a vertical plane passing through the protrusion and the light-blocking plate 67.

<Internal Structure of Casing 31>

As illustrated in FIG. 7, the first storage chamber 32, second storage chamber 33, ink valve chamber 35, and air valve chamber 36 are formed inside the cartridge body 31. The first storage chamber 32, second storage chamber 33, and air valve chamber 36 are examples of a liquid chamber. The ink valve chamber 35 is an example of a liquid passage. Each of the first storage chamber 32, second storage chamber 33, ink valve chamber 35, and air valve chamber 36 can store ink. Also provided inside the cartridge body 31 are a partition wall 44 for partitioning the first storage chamber 32 from the air valve chamber 36, and a lower wall 45 for partitioning the first storage chamber 32 from the second storage chamber 33. The partition wall 44 and lower wall 45 extend in both the front-rear and left-right directions and oppose each other vertically.

The first storage chamber 32 is a space defined on the top by the bottom surface of the partition wall 44, defined on the bottom by the top surface of the lower wall 45, and defined on the front, rear, right, and left by the inner surfaces of the front wall 40, rear wall 41, and side walls 37 and 38, respectively. A through-hole 46 is formed in the partition wall 44. The through-hole 46 provides communication between the first storage chamber 32 and air valve chamber 36.

The second storage chamber 33 is positioned below the first storage chamber 32. The volume of ink that the second storage chamber 33 can store is smaller than the volume of ink that the first storage chamber 32 can store.

The second storage chamber 33 is a space that is defined on the top by the bottom surface of the lower wall 45, on the bottom by the top surface of the bottom wall 42, and on the rear, right, and left by the inner surfaces of the rear wall 41 and the side walls 37 and 38, respectively. A partition wall 50 is formed between the second storage chamber 33 and the ink valve chamber 35. The partition wall 50 defines the front portion of the second storage chamber 33. The second storage chamber 33 communicates with the first storage chamber 32 through a communication port 47 formed in the lower wall 45. The second storage chamber 33 also communicates with the ink valve chamber 35 via a through-hole 99 formed in the partition wall 50.

As illustrated in FIG. 3, the valve 97 and coil spring 98 are accommodated in the air valve chamber 36. The air valve chamber 36 communicates with the outside of the ink cartridge 30 through the air communication port 96 formed in the sub-front wall 95. The valve 97 can move between a closed position for sealing the air communication port 96, and an open position separated from the air communication port 96. The coil spring 98 is oriented to be compressible in the front-rear direction and urges the valve 97 forward, i.e., in the direction for contacting the air communication port 96. The spring constant of the coil spring 98 is smaller than the spring constant of the coil spring 78 disposed in the ink supply portion 34.

The ink supply portion 34 has a cylindrical external shape. The ink supply portion 34 includes a cylinder 75 with an opening on the front end, and packing 76. The cylinder 75 protrudes forward from the sub-front wall 49. That is, the ink supply portion 34 is provided on the sub-front wall 49. The interior space of the cylinder 75 constitutes the ink valve chamber 35. In other words, the ink valve chamber 35 extends in the front direction (example of a first direction) when the ink cartridge 30 is in the upright posture. The ink valve chamber 35 is elongated in the front-rear direction when the ink cartridge 30 is in the upright posture. The rear end of the ink valve chamber 35 is in communication with the second storage chamber 33 through the through-hole 99. The front end of the cylinder 75 is open to the exterior of the ink cartridge 30. Hence, the ink valve chamber 35 is in communication with both the second storage chamber 33 and the exterior of the ink cartridge 30. In other words, the ink valve chamber 35 extends in the front-rear direction to allow ink in the second storage chamber 33 to flow forward toward the outside of the ink cartridge 30. The packing 76 is provided in the front end of the cylinder 75. That is, the packing 76 is disposed in the front end of the ink valve chamber 35.

The ink valve chamber 35 accommodates a valve 77, and the coil spring 78. By moving along the front-rear direction, the valve 77 opens and closes the ink supply port 71 penetrating the center of the packing 76. The coil spring 78 urges the valve 77 forward. Therefore, when an external force is not applied to the valve 77, the valve 77 closes the ink supply port 71 in the packing 76.

The packing 76 is a disk-shaped member with a through-hole formed in the center thereof. The packing 76 is formed of a resilient material such as a rubber or elastomer. When the center of the packing 76 is penetrated in the front-rear direction, a tube-shaped inner circumferential surface is formed therein. The ink supply port 71 is defined by the tube-shaped inner circumferential surface. The inner diameter of the ink supply port 71 is slightly smaller than the outer diameter of the ink needle 102. The ink supply port 71 is in communication with the interior space of the cylinder 75 (the ink valve chamber 35) and the exterior of the ink cartridge 30. Hence, the ink valve chamber 35 is in communication with the second storage chamber 33 and the exterior of the ink cartridge 30 through the ink supply port 71, which is open on the front side.

When the ink cartridge 30 is inserted into the cartridge-attachment section 110 while the valve 77 is closing the ink supply port 71, the ink needle 102 advances into the ink supply port 71, as illustrated in FIG. 3. As the packing 76 resiliently deforms, the outer circumferential surface of the ink needle 102 forms close contact with the inner circumferential surface defining the ink supply port 71. In other words, communication between the ink valve chamber 35 and the exterior of the ink cartridge 30 via the ink supply port 71 is hermetically sealed. Subsequently, the distal end of the ink needle 102 passes through the ink supply port 71 formed in the packing 76, advances into the ink valve chamber 35, and contacts the valve 77. As the ink cartridge 30 is further inserted into the cartridge-attachment section 110, the ink needle 102 moves the valve 77 rearward against the urging force of the coil spring 78. As a result, ink stored in the ink valve chamber 35 is able to flow into the interior space 102A of the ink needle 102.

Note that the ink supply port 71 may be sealed by a film rather than the valve 77. In this case, the ink supply port 71 may be configured of the front end of the cylinder 75 rather than the packing 76. Alternatively, the ink supply port 71 may be formed of a resilient resin or other sealing member that has no through-hole and must be penetrated by the needle. In this case, the resiliency of the sealing member can reseal the ink supply port 71 when the needle is extracted from the sealing member. Further, the ink supply portion 34 need not be formed as a cylindrically shaped member. For example, a through-hole may be formed in the front wall 40 of the cartridge body 31 that penetrates the front wall 40 in the front-rear direction. In this case, a portion of the ink supply portion 34 may be configured of the front wall 40 in which the through-hole is formed.

<Operation for Mounting Ink Cartridge 30 in Cartridge-Attachment Section 110>

Next, the operations for mounting the ink cartridge 30 in the cartridge-attachment section 110 will be described.

FIG. 7 shows the ink cartridge 30 prior to being attached in the cartridge-attachment section 110. As illustrated in FIG. 7, the valve 77 closes the ink supply port 71 formed in the packing 76. This closure interrupts the flow of ink from the ink valve chamber 35 to the exterior of the ink cartridge 30. Further, the valve 97 closes the air communication port 96. This prevents the first storage chamber 32 from being open to the atmosphere.

The user inserts the ink cartridge 30 in its upright posture into the case 101 (see FIG. 2) through the opening 112 of the cartridge-attachment section 110. The upper portion 41U of the rear wall 41 constituting the cartridge body 31 is positioned rearward relative to the lower portion 41L. That is, the upper portion 41U is positioned closer than the lower portion 41L to the user. Accordingly, the user pushes against the upper portion 41U in a frontward direction to insert the ink cartridge 30 into the cartridge-attachment section 110. The lower portion of the ink cartridge 30 advances in the guide groove 109 formed in the bottom of the case 101 (see FIG. 2).

Figure 8:
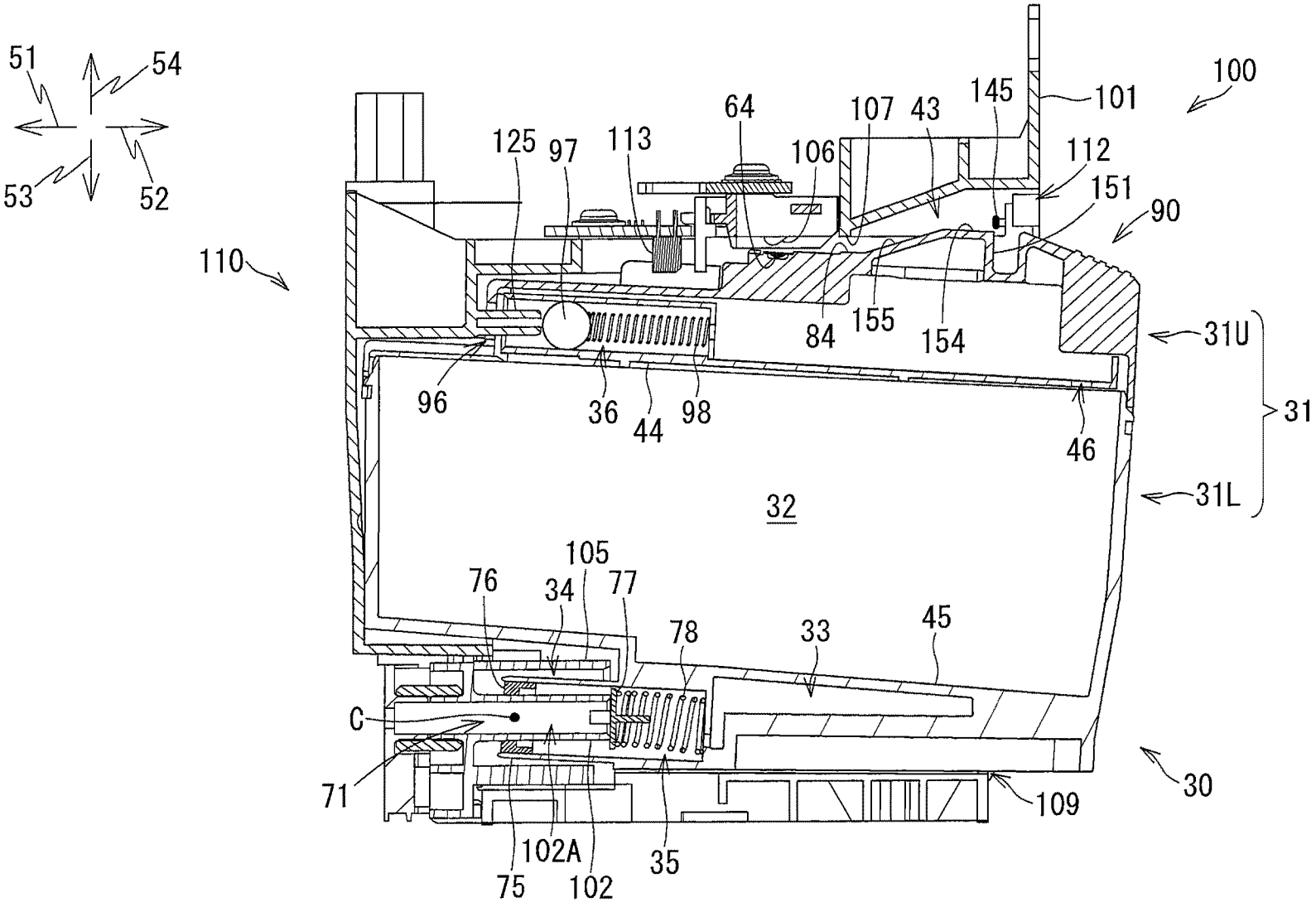
FIG. 8 is a vertical cross-sectional view of the cartridge-attachment section according to the embodiment, illustrating a state where the ink cartridge according to the embodiment is being inserted into the cartridge-attachment section.

As the ink cartridge 30 is inserted into the case 101, the ink supply portion 34 advances into the guide portion 105, as illustrated in FIG. 8. The rod 125 also advances through the air communication port 96. In addition, the light-blocking plate 67 (see FIG. 7) becomes positioned between the light-emitting portion and light-receiving portion of the optical sensor 113.

As the front wall 40 of the ink cartridge 30 approaches the inner front surface of the case 101, the ink needle 102 passes through the ink supply port 71 and enters the ink valve chamber 35, forcing the valve 77 to separate from the packing 76 against the urging force of the coil spring 78. This action also positions the ink supply portion 34. At this time, ink stored in the ink valve chamber 35 can flow into the interior space 102A of the ink needle 102. In addition, the rod 125 passing through the air communication port 96 contacts the valve 97 and forces the valve 97 to separate from the air communication port 96 against the urging force of the coil spring 98. Through this operation, the first storage chamber 32 is opened to the atmosphere through the through-hole 46, air valve chamber 36, and air communication port 96.

In this state, the compressed coil springs 78 and 98 apply an urging force in the rearward direction to the ink cartridge 30. The magnitude of the urging force generated by each of the coil springs 78 and 98 is determined by the spring constant of the spring and the distance compressed from its natural length. The spring constant of the coil spring 98 is smaller than the spring constant of the coil spring 78. Further, the distance that the coil spring 78 is compressed (the distance that the valve 77 is separated from the ink supply port 71) is greater than the distance that the coil spring 98 is compressed (the distance that the valve 97 is separated from the air communication port 96). Consequently, the magnitude of the urging force generated by the coil spring 78 is greater than the magnitude of the urging force generated by the coil spring 98.

When the protruding portion 43 arrives at the lock shaft 145, the inclined surface 155 slides against the lock shaft 145. As the user continues to push the upper portion 41U of the rear wall 41 forward, torque is applied to the ink cartridge 30 in the counterclockwise direction of FIG. 8. However, due to the contact between the inclined surface 155 and lock shaft 145, the ink cartridge 30 rotates against this torque about a center C of the ink supply port 71 in which the ink needle 102 is inserted. The position of the center C in the ink cartridge 30 depends on the shape of the ink needle 102 and the shape of the ink supply port 71, but the center of the area in which the ink needle 102 contacts the inner surface of the cylindrical ink supply portion 34 is the hypothetical center of rotation. In the preferred embodiment, the hypothetical center of rotation is the center of the portion of the ink needle 102 that contacts the inner circumferential surface of the packing 76 defining the ink supply port 71, and the ink cartridge 30 rotates clockwise about this center of rotation. The orientation of the ink cartridge 30 at this point (the orientation of the ink cartridge 30 illustrated in FIG. 8) will be called the second posture.

Forming the bottom wall 42 of the cartridge body 31 as a sloped surface that slopes relative to the front-rear direction provides space between the bottom wall 42 and the inner bottom surface of the guide groove 109 constituting the case 101. The space is needed for this rotation (clockwise rotation). Further, since the inner diameter of the air communication port 96 is greater than the outer diameter of the rod 125, there is space between the rod 125 and air communication port 96 to allow for this rotation (clockwise rotation) without the rod 125 contacting the air communication port 96 when the ink cartridge 30 is in the attached posture. Hence, the rod 125 and air communication port 96 are not involved in the vertical positioning of the ink cartridge 30.

When the ink cartridge 30 is inserted into the case 101, the circuit board 64 becomes positioned below the contact 106. Owing to the above clockwise rotation, a vertical gap exists between the electrodes 65 of the circuit board 64 and the contact 106 when the ink cartridge 30 is in the second posture. In other words, the electrodes 65 are separated from the contact 106. Additionally, the contact surface 84 becomes positioned beneath the positioning portion 107, but a vertical gap exists between the contact surface 84 and the positioning portion 107 when the ink cartridge 30 is in the second posture. Hence, the contact surface 84 is separated from the positioning portion 107.

As the ink cartridge 30 is inserted frontward against the urging force of the coil spring 78, the inclined surface 155 and horizontal surface 154 of the protruding portion 43 move closer to the inner front surface of the case 101 than the lock shaft 145. With the ink cartridge 30 in the second posture, the locking surface 151 is positioned beneath the lock shaft 145.

As the user continues to push forward on the upper portion 41U of the rear wall 41, torque is applied to the ink cartridge 30 in the counterclockwise direction in FIG. 8. Since the inclined surface 155 and horizontal surface 154 no longer contact the lock shaft 145, the force applied by the user rotates the ink cartridge 30 against the urging force of the coil spring 98 in the counterclockwise direction in FIG. 8 about the center C of the ink supply port 71 in which the ink needle 102 is inserted. As a result, the contact surface 84 contacts the positioning portion 107 from below (see FIG. 3).

When the ink cartridge 30 is in the orientation illustrated in FIG. 3, the locking surface 151 confronts the lock shaft 145 in the rearward direction. When the user stops pushing the ink cartridge 30 forward, the urging force of the coil spring 78 moves the ink cartridge 30 rearward. However, since the locking surface 151 confronts the lock shaft 145 in the rearward direction, the locking surface 151 contacts the lock shaft 145 from the front side as the ink cartridge 30 moves rearward and restricts further rearward movement of the ink cartridge 30. Further, the contact between the contact surface 84 and the positioning portion 107 restricts the ink cartridge 30 from moving farther upward, i.e., from rotating farther counterclockwise about the center C. As a result, the ink cartridge 30 is fully attached in the cartridge-attachment section 110 and fixed in position. The orientation of the ink cartridge 30 at this time (the orientation of the ink cartridge 30 illustrated in FIG. 3) is called the first posture. This state is considered the attached state in which the ink cartridge 30 is in the attached posture.

As described above, the ink cartridge 30 can shift between the first posture and second posture during the insertion operation of the ink cartridge 30 by rotating about the center C.

In the attached state, the circuit board 64 is positioned rearward relative to the ink needle 102. Further, when the ink cartridge 30 is in the first posture in the attached state, the electrodes 65 of the circuit board 64 contact the contact 106 from below. That is, the electrodes 65 resiliently deform the contact 106 upward, forming an electrical connection with the same.

In the attached state, the light-blocking plate 67 is positioned between the light-emitting portion and light-receiving portion of the optical sensor 113, thereby blocking the passage of light from the light-emitting portion to the light-receiving portion. That is, in the attached state, the light-blocking plate 67 is positioned in the optical path of light emitted by the light-emitting portion. Consequently, the optical sensor 113 outputs a low level detection signal (the signal indicating that the light-blocking plate 67 is detected) to the controller 11 (see FIG. 1). Hence, the light-blocking plate 67 is detected during the attached state by blocking light emitted by the optical sensor 113. As described earlier, the light-blocking plate 67 may also be detected by attenuating light emitted from the optical sensor 113 during the attached state.

When removing the ink cartridge 30 from the cartridge-attachment section 110, the user presses down on the operating surface 92. When the ink cartridge 30 is in the first posture, the operating surface 92 faces diagonally upward and rearward. Therefore, when the user operates the operating surface 92, a force in a direction diagonally downward and forward is applied to the ink cartridge 30. This force rotates the ink cartridge 30 clockwise in FIG. 3, thereby separating the contact surface 84 from the positioning portion 107, as illustrated in FIG. 8. Further, the locking surface 151 moves below the lock shaft 145. In other words, the ink cartridge 30 shifts from the first posture to the second posture. At this time, the urging force of the coil spring 78 moves the ink cartridge 30 rearward relative to the cartridge-attachment section 110 and the user can extract the ink cartridge 30 from the cartridge-attachment section 110.

<Detection of Ink Cartridge 30 Inserted in Cartridge-Attachment Section 110>

Next, the operations for detecting the ink cartridge 30 being inserted in the cartridge-attachment section 110 will be described with reference to the flowcharts in FIGS. 11 and 12.

As illustrated in FIG. 9, in S10 the controller 11 (see FIG. 1) determines whether the circuit board 64 of the ink cartridge 30 is accessible. When the contact 106 contacts the circuit board 64 so as to be electrically connected to the same, the controller 11 can access the circuit board 64. When the contact 106 does not contact the circuit board 64, the controller 11 cannot access the circuit board 64.

If the controller 11 cannot access the circuit board 64 (S10: NO), in S20 the controller 11 determines that the ink cartridge 30 is not attached in the cartridge-attachment section 110. In this case, the controller 11 notifies the user that an ink cartridge 30 is not attached by displaying a message on a display panel (not illustrated) provided on the housing of the printer 10 and/or emitting a beep or other sound from a speaker (not illustrated).

However, if the controller 11 can access the circuit board 64 (S10: YES), in S30 the controller 11 determines whether the signal outputted from the optical sensor 113 is high level or low level. When the light-blocking plate 67 is positioned between the light-emitting portion and light-receiving portion of the optical sensor 113, the optical sensor 113 outputs a low level signal to the controller 11. When the light-blocking plate 67 is not positioned between the light-emitting portion and light-receiving portion of the optical sensor 113, the optical sensor 113 outputs a high level signal to the controller 11.

If the signal outputted from the optical sensor 113 to the controller 11 is the high level (S30: HIGH), in S40 the controller 11 determines that an abnormal ink cartridge 30 is attached in the cartridge-attachment section 110. In this case, the controller 11 notifies the user that an abnormal ink cartridge 30 is attached by displaying a message on the display panel (not illustrated) provided on the housing of the printer 10 and/or plays a beep or other sound from the speaker (not illustrated).

On the other hand, if the signal outputted by the optical sensor 113 is the low level (S30: LOW), in S50 the controller 11 determines that a normal ink cartridge 30 is attached in the cartridge-attachment section 110.

Figure 11:
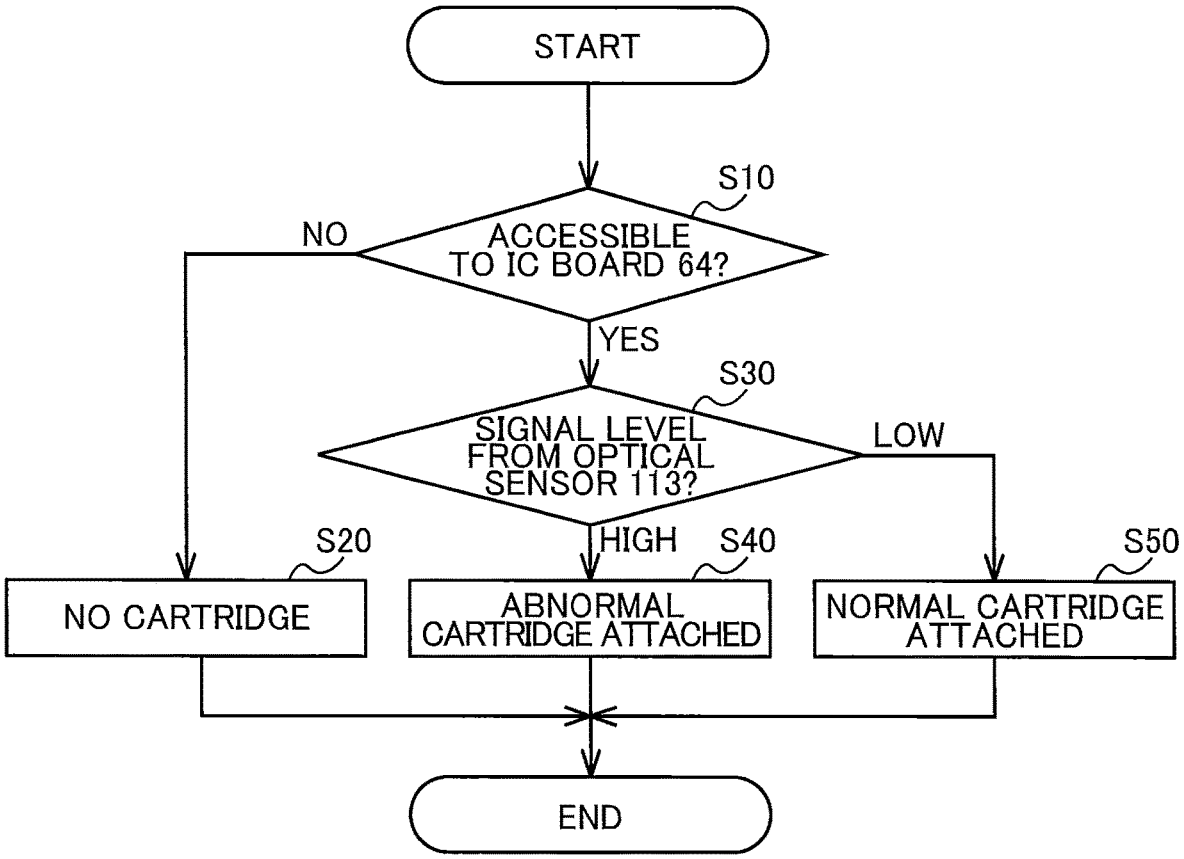
FIG. 11 is a flowchart illustrating steps for detecting insertion of the ink cartridge according to the embodiment into the cartridge-attachment section according to the embodiment.

In the flowchart of FIG. 11, the controller 11 determines whether an ink cartridge 30 is attached in the cartridge-attachment section 110 based on whether the circuit board 64 is accessible and determines whether the ink cartridge 30 attached in the cartridge-attachment section 110 is normal based on the level of signal outputted from the optical sensor 113.

However, the controller 11 may be configured to determine whether an ink cartridge 30 is attached in the cartridge-attachment section 110 based on the level of the signal outputted from the optical sensor 113 and to determine whether the ink cartridge 30 attached in the cartridge-attachment section 110 is normal based on whether the circuit board 64 is accessible. Steps in this modification will be described next with reference to the flowchart in FIG. 12.

Figure 12:
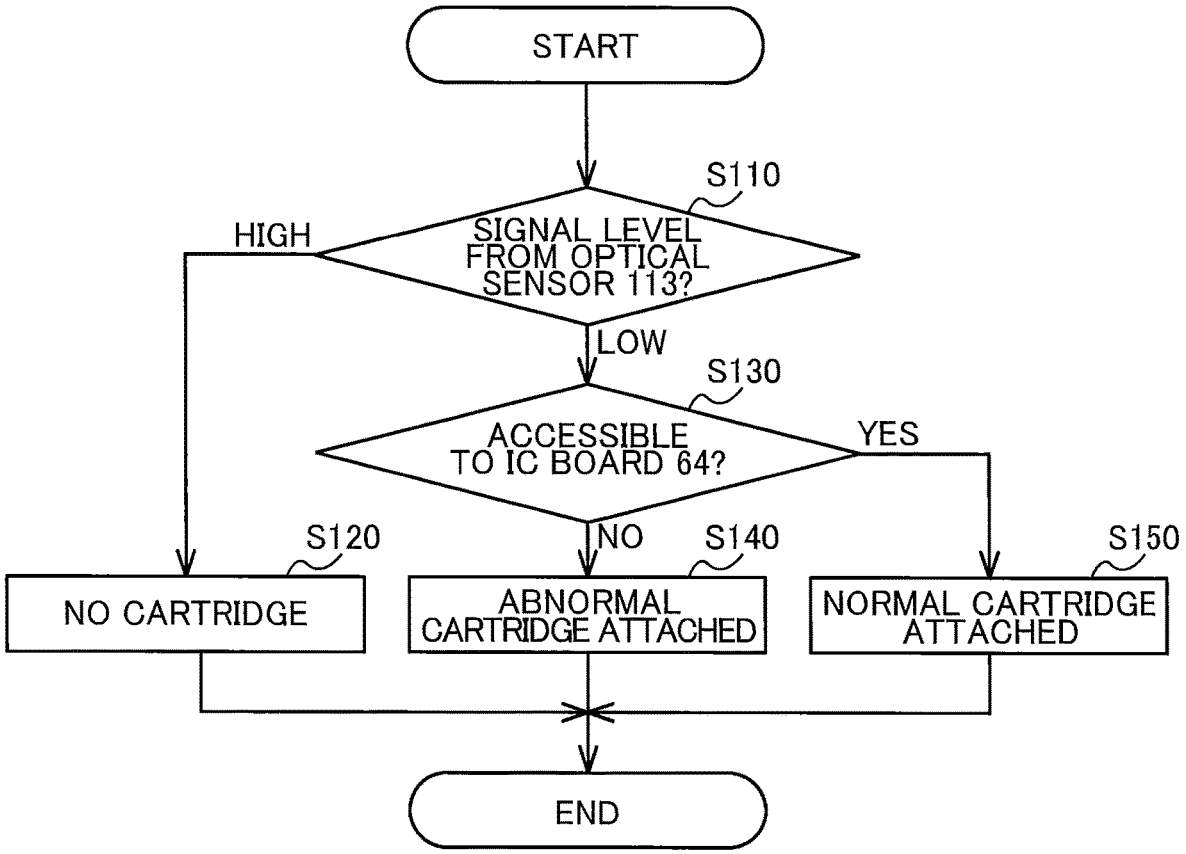
FIG. 12 is a flowchart illustrating another method of detecting insertion of the ink cartridge into the cartridge-attachment section according to the embodiment.

As illustrated in FIG. 12, in S110 the controller 11 determines whether the signal outputted by the optical sensor 113 to the controller 11 is the high level or low level.

If the signal outputted by the optical sensor 113 is the high level (S110: HIGH), in S120 the controller 11 determines that an ink cartridge 30 is not attached in the cartridge-attachment section 110. In this case, as in S20 of FIG. 11, the controller 11 notifies the user that an ink cartridge 30 is not attached.

However, if the signal outputted by the optical sensor 113 is the low level (S110: LOW), in S130 the controller 11 determines whether the circuit board 64 of the ink cartridge 30 is accessible.

If the controller 11 cannot access the circuit board 64 (S130: NO), in S140 the controller 11 determines that an abnormal ink cartridge 30 is attached in the cartridge-attachment section 110. In this case, as in S40 of FIG. 11, the controller 11 notifies the user that an abnormal ink cartridge 30 is attached.

On the other hand, if the controller 11 can access the circuit board 64 (S130: YES), in S150 the controller 11 determines that a normal ink cartridge 30 is attached in the cartridge-attachment section 110.

[Technical Effect of Embodiment]

In the preferred embodiment, the light-blocking plate 67 is deformable by external forces. Therefore, if the light-blocking plate 67 incurs an external impact when the ink cartridge 30 is dropped, for example, the light-blocking plate 67 can deform to absorb this impact, thereby reducing the potential for damage to the light-blocking plate 67. In addition, the light-blocking plate 67 can return to its original shape once the external force is removed. Hence, the light-blocking plate 67 can still perform its function of blocking or attenuating light irradiated from an external unit even after incurring an external impact.

In the preferred embodiment, the left-right dimension of the light-blocking plate 67 is shorter than the left-right dimension of the top surface of the cartridge body 31, and the front-rear dimension of the light-blocking plate 67 is shorter than the front-rear dimension of the top surface of the cartridge body 31. Therefore, the light-blocking plate 67 is easily deformed by external forces, enabling the light-blocking plate 67 to readily absorb external impacts.

The light-blocking plate 67 according to the preferred embodiment can be made with short left-right and front-rear dimensions. As a result, the ink cartridge 30 can be configured with shorter left-right and front-rear dimensions.

By configuring the light-blocking plate 67 in a plate shape in the preferred embodiment, the light-blocking plate 67 is easily deformed by external forces. Accordingly, the light-blocking plate 67 can readily absorb external impacts.

The light-blocking plate 67 is flexible in the preferred embodiment. Accordingly, the light-blocking plate 67 can bend when incurring an external impact to reduce its effect.

In the preferred embodiment, the light-blocking plate 67 is formed of a synthetic resin that includes a black pigment. This composition enhances the ability of the light-blocking plate 67 to block light.

In the preferred embodiment, the light-blocking plate 67 is positioned lower than the circuit board 64. Accordingly, this arrangement reduces the possibility that the contact 106 provided in the cartridge-attachment section 110 will contact the light-blocking plate 67 as the ink cartridge 30 is inserted into the cartridge-attachment section 110.

In the preferred embodiment, the circuit board 64 is positioned lower than the virtual line 165. Consequently, if the ink cartridge 30 is dropped with the top surface of the cartridge body 31 facing downward, the light-blocking plate 67 will impact the ground or the like prior to the circuit board 64. Since the circuit board 64 impacts the ground or the like after the light-blocking plate 67 has hit the ground and deformed, the impact to the circuit board 64 can be reduced.

[Variations and Modifications]

The light-blocking plate 67 may be provided with a notch 69 in its bottom edge. For example, the notch 69 may be cut out from the front edge of the light-blocking plate 67, as illustrated in a first modification of FIG. 13. That is, the light-blocking plate 67 has a portion spaced away from the top surface of the top wall 39.

Figure 13:
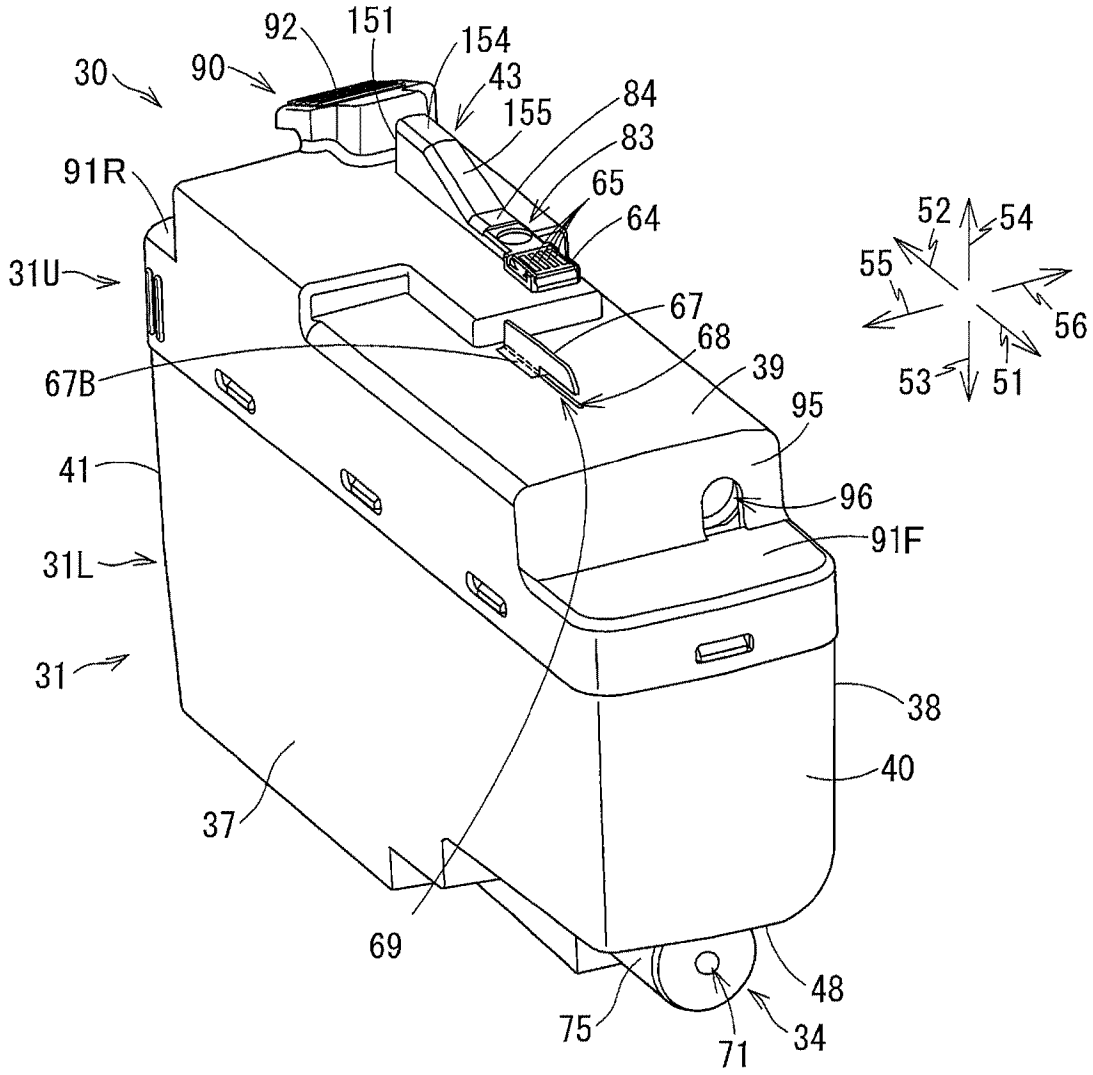
FIG. 13 is a perspective view of an ink cartridge having a light-blocking plate formed with a notch as viewed from its front side, according to a first modification.

When vertically viewing the ink cartridge 30 according to the modification illustrated in FIG. 13, the area of the bottom edge portion of the light-blocking plate 67 is smaller than the area in other portions of the light-blocking plate 67 that do not include the notch 69. Accordingly, the light-blocking plate 67 more easily deforms about its bottom edge when incurring external forces. This arrangement can reduce the potential for damage to the light-blocking plate 67 occurring when the light-blocking plate 67 resists external impacts without deforming.

Since the ink cartridge 30 is inserted frontward into the cartridge-attachment section 110, there is a high possibility that the ink cartridge 30 will contact and receive an impact from a member configuring the cartridge-attachment section 110, such as the optical sensor 113, when the ink cartridge 30 is inserted into the cartridge-attachment section 110. In the first modification illustrated in FIG. 13, the light-blocking plate 67 has the notch 69 formed in the front edge thereof. Hence, when receiving an impact from the front side, the light-blocking plate 67 easily deforms either in the right-rear direction or the left-rear direction, thereby reducing the potential for damage to the light-blocking plate 67.

Note that the notch 69 is not limited to the configuration illustrated in FIG. 13. For example, the notch 69 may be cut out forward from the rear edge of the light-blocking plate 67. Alternatively, notches 69 may be cut out in both the front and rear edges of the light-blocking plate 67.

In the preferred embodiment, the light-blocking plate 67 is formed of a composition that includes a color material capable of absorbing light (a black pigment, for example), but the light-blocking plate 67 need not include such a color material. In this case, the light-blocking plate 67 may be configured of a plate that allows transmission of light (an example of the first part) and a material such as aluminum foil (an example of the second part) having a higher opacity (more impenetrable to light) than the plate that is affixed or adheres to at least one of the left side surface and right side surface of the plate, i.e., the portion of the plate irradiated by light emitted from the optical sensor 113.

By affixing a material such as aluminum foil having a high opacity to the surface of a plate constituting the light-blocking plate 67, as described above, this configuration can enhance the opacity of the light-blocking plate 67 while maintaining the functionality of the light-blocking plate 67 for deforming when incurring external forces.

While the light-blocking plate 67 is formed of a synthetic polymer in the preferred embodiment, the light-blocking plate 67 may be formed of a material other than a synthetic polymer. For example, the light-blocking plate 67 may be formed of a metal, sheets, or natural rubber. Note that when forming the light-blocking plate 67 of a metal, the light-blocking plate 67 can still be made flexible by using a thin plate shape.

Figure 14:
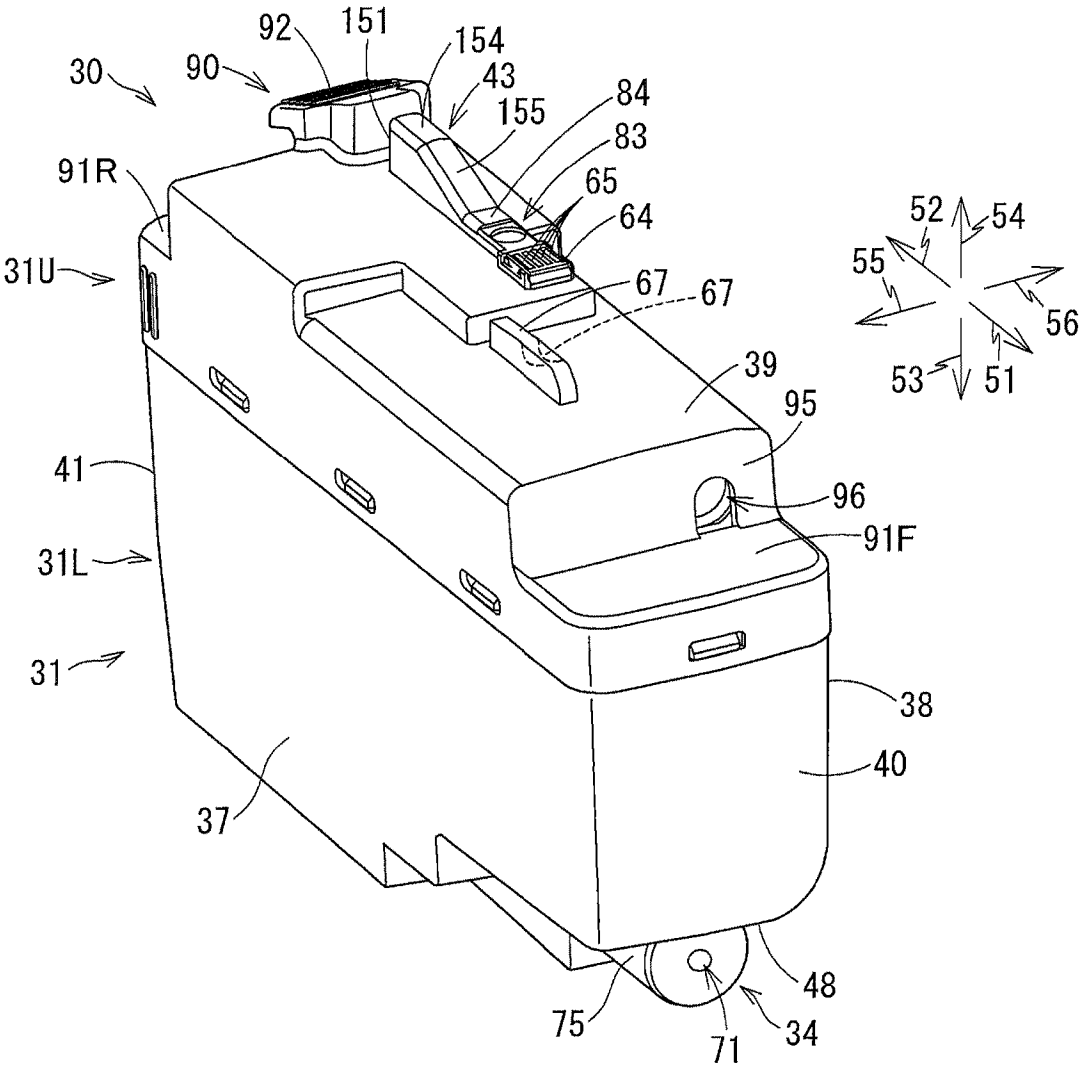
FIG. 14 is a perspective view of an ink cartridge having a light-blocking plate made from a porous material as viewed from its front side, according to a second modification.

The light-blocking plate 67 may also be formed of a sponge or other porous material. In this case, the light-blocking plate 67 should be configured as a rectangular parallelepiped having a thicker left-right dimension than the light-blocking plate 67 illustrated in FIG. 4, as illustrated in a second modification of FIG. 14. A light-blocking plate 67 formed of this material yields when receiving a force from an external part. For example, the surface of the light-blocking plate 67 may become dented as depicted by the dashed line in FIG. 14 when receiving a force from above. When the force is removed, the light-blocking plate 67 returns to its original state prior to incurring the force. Thus, this light-blocking plate 67 has resiliency but not necessarily flexibility. Hence, the light-blocking plate 67 need not have flexibility provided that it resiliently deforms in response to an external force.

As illustrated in FIGS. 4-6, the light-blocking plate 67 of the preferred embodiment has a plate shape with a narrow dimension in the left-right direction, longer vertical and front-rear dimensions than the left-right dimension, and a longer front-rear dimension than the vertical dimension. However, the shape of the light-blocking plate 67 is not limited to that illustrated in FIGS. 4-6. For example, the light-blocking plate 67 may be formed with a longer vertical dimension than front-rear dimension.

Figure 15:
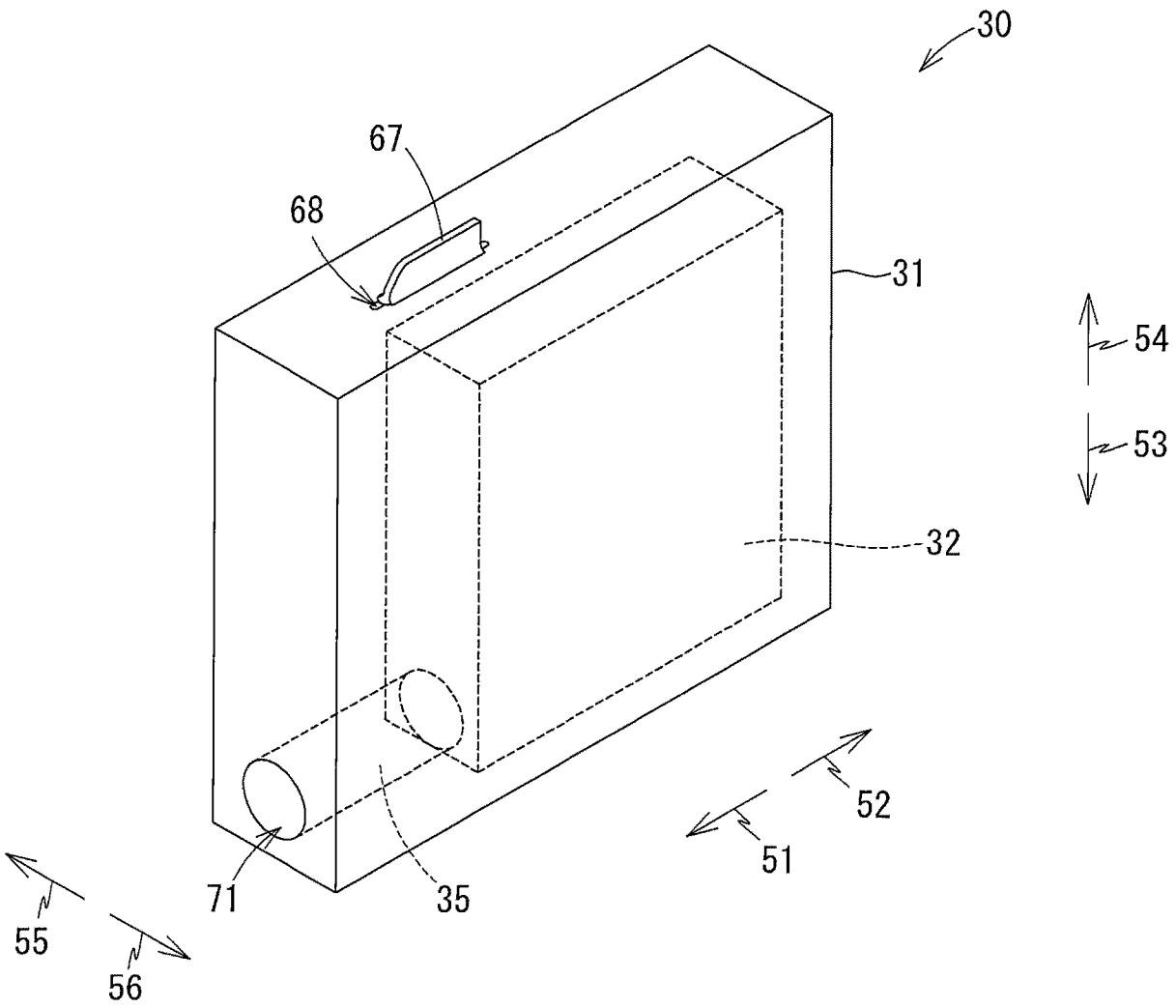
FIG. 15 is a perspective view of an ink cartridge according to a third modification as viewed from its front side.

The ink cartridge 30 is not limited to the structure illustrated in FIGS. 4-6. For example, the ink cartridge 30 may be configured as illustrated in a third modification in FIG. 15. As illustrated in FIG. 15, the outer shape of the ink cartridge 30 is similar to a rectangular parallelepiped. In this example, the ink cartridge 30 is not provided with the circuit board 64, protruding portion 83, and retaining part (the protruding portion 43).

Although the ink cartridge 30 illustrated in FIG. 15 is not provided with the retaining part, the ink cartridge 30 can be retained in its attached state in the cartridge-attachment section 110 through sliding friction generated between the ink needle 102 inserted into the ink supply port 71 (see FIG. 2) and the inner circumferential surface of the packing 76.

In other words, the configuration for retaining the ink cartridge 30 in its attached state in the cartridge-attachment section 110 is not limited to a configuration involving the locking surface 151 and rotation of the ink cartridge 30 from its first posture to its second posture. For example, the ink cartridge 30 may be attached horizontally into the cartridge-attachment section 110 without being rotated; that is, the ink cartridge 30 may be maintained in its first posture while being attached into the cartridge-attachment section 110.

The ink cartridge 30 having the structure illustrated in FIG. 15 is also not provided with the coil springs 78 and 98. Therefore, the ink cartridge 30 can be inserted into the cartridge-attachment section 110 without opposing a rearward urging force.

The positional relationships of components in the ink cartridge 30 and cartridge-attachment section 110 are also not limited to those described in the preferred embodiment. For example, the light-blocking plate 67 may be positioned above the circuit board 64. Further, the circuit board 64 may be positioned above the virtual line 165.

In the preferred embodiment, ink is described as an example of liquid, but the liquid cartridge may store a liquid other than ink, such as a pretreatment liquid that is ejected onto the sheets or the like prior to ink during a printing operation, or water for cleaning the recording head 21.

What is claimed is:

1. A liquid cartridge configured to be inserted into a cartridge-attachment section comprising:

a casing comprising:

a liquid chamber storing liquid therein;

a liquid passage extending in a first direction crossing a gravitational direction from a liquid chamber in an upright posture of the liquid cartridge; and a top surface facing upward; and a light blocking portion protruding upward relative to the top surface, the light blocking portion being at an original state when no external force is applied to the light blocking portion, the light blocking portion at the original state being configured to block or attenuate light emitted from the cartridge-attachment section and traveling in a widthwise direction crossing the first direction and the gravitational direction in the upright posture, each part of the light blocking portion being located at its original position relative to the casing when the light blocking portion is at the original state, the light blocking portion being configured such that when an external force is applied to part of the light blocking portion, the part of the light blocking portion to which the external force is applied is moved to a position different from its original position relative to the casing, and when the external force is removed from the part of the light blocking portion, the part of the light blocking portion is moved back to the original position to an extent that the light blocking portion can block or attenuate the light, wherein the casing has a front-end portion and a rear-end portion, the first direction being directed from the rear-end portion to the front-end portion, the rear-end portion being rearward of the front-end portion in the first direction; and wherein the liquid cartridge further comprises a circuit board positioned at the top surface rearward relative to the light blocking portion in the first direction, the circuit board being configured to contact with an electrical contact provided at the cartridge-attachment section.

2. The liquid cartridge according to claim 1, wherein the light blocking portion has a length in the first direction smaller than that of the top surface in the widthwise direction.

3. The liquid cartridge according to claim 1, wherein the light blocking portion at the original state has a length in the first direction smaller than that of the top surface in the first direction.

4. The liquid cartridge according to claim 1, wherein the light blocking portion at the original state has a length in the widthwise direction smaller than that of the tip surface in the first direction.

5. The liquid cartridge according to claim 1, wherein the light blocking portion at the original state has a length in the widthwise direction smaller than that of the light blocking portion in the gravitational direction.

6. The liquid cartridge according to claim 1, wherein the light blocking portion has a resiliency.

7. The liquid cartridge according to claim 1, wherein the light blocking portion has a notch formed in a bottom edge thereof.

8. The liquid cartridge according to claim 7, wherein the casing has a front-end portion and a rear-end portion, the first direction being directed from the read-end portion to the front-end portion, the rear-end portion being rearward of the front-end portion in the first direction; and wherein the notch is formed in a front edge of the light blocking portion.

9. The liquid cartridge according to claim 1, wherein the light blocking portion is made from resin.

10. The liquid cartridge according to claim 1, wherein the resin contains black pigment.

11. The liquid cartridge according to claim 1, wherein the light blocking portion has:

a first part having a surface irradiated by the light emitted from the cartridge-attachment section; and a second part adhered to the surface of the first part, the second part being formed of a material different from a material of the first part, the material of the second part providing an opacity higher than that of the material of the first part.

12. The liquid cartridge according to claim 1, wherein the light blocking portion is positioned downward relative to the circuit board.

13. The liquid cartridge according to claim 1, wherein the liquid cartridge is inserted into the cartridge-attachment section against an urging force acting in a direction opposite to the first direction;

the liquid cartridge having a protrusion positioned rearward relative to the circuit board, the protrusion and the light blocking portion defining a plurality of imaginary planes each of which passes through the protrusion and the light blocking portion, each of the plurality of imaginary planes extending in the widthwise direction, the plurality of imaginary planes including a specific imaginary plane defined by the protrusion and the light blocking portion, the specific imaginary plane being positioned higher than any other imaginary plane between the protrusion and the light blocking portion, the circuit board being positioned downward relative to the specific imaginary plane in the gravitational direction in the upright posture.

14. The liquid cartridge according to claim 13, further comprising an engaging surface configured to engage with an engagement portion in the cartridge-attachment section;

wherein the liquid cartridge is movable between a first posture and a second posture relative to the cartridge-attachment section during insertion of the liquid cartridge into the cartridge-attachment section, the engaging surface in the first posture being in abutment with the engagement portion to maintain the liquid cartridge in the upright posture, the engaging surface being positioned below the engagement portion to be disengaged therefrom in the second posture.

15. The liquid cartridge according to claim 1, wherein the light blocking portion is configured to be detected by an optical sensor provided in the cartridge-attachment section by blocking or attenuating light from the optical sensor.

16. The liquid cartridge according to claim 1, wherein the light blocking portion is configured such that when the external force is applied to the part of the light blocking portion, the part of the light blocking portion moves relative to the casing about a position that is further downward relative to the light blocking portion.

* * * * *